US006324370B1

(12) United States Patent
Isobe et al.

(10) Patent No.: US 6,324,370 B1
(45) Date of Patent: Nov. 27, 2001

(54) ELECTROPHOTOGRAPHIC IMAGE FORMING APPARATUS DETACHABLY MOUNTING A DEVELOPER REPLENISHING CONTAINER OR IN WHICH A PLURALITY OF CARTRIDGES AND DEVELOPER REPLENISHING CONTAINERS ARE ATTACHABLY AND DETACHABLY POSITIONED

(75) Inventors: Hironobu Isobe; Kenji Matsuda; Akiyoshi Fujita, all of Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/532,023

(22) Filed: Mar. 21, 2000

(30) Foreign Application Priority Data

Mar. 29, 1999 (JP) ..... 11-087072

(51) Int. Cl.[7] ..... G03G 15/08
(52) U.S. Cl. ..... 399/258; 399/262; 222/DIG. 1
(58) Field of Search ..... 222/DIG. 1; 399/119, 399/120, 258, 26 D, 262, 263

(56) References Cited

U.S. PATENT DOCUMENTS

| | | | | |
|---|---|---|---|---|
| 5,331,373 | | 7/1994 | Nomura et al. . | |
| 5,452,056 | | 9/1995 | Nomura et al. . | |
| 5,528,341 | | 6/1996 | Shishido et al. . | |
| 5,585,889 | | 12/1996 | Shishido et al. . | |
| 5,642,187 | | 6/1997 | Nomura | 399/111 |
| 5,650,841 | | 7/1997 | Matsuda et al. | 399/111 |
| 5,678,139 | | 10/1997 | Nomura et al. | 399/114 |
| 5,697,022 | | 12/1997 | Matsuda et al. | 399/102 |
| 5,802,441 | * | 9/1998 | Okada | 399/262 |
| 5,819,144 | * | 10/1998 | Okada et al. | 399/258 |
| 5,825,472 | | 10/1998 | Araki et al. . | |
| 5,903,806 | * | 5/1999 | Matsuoka et al. | 399/258 |
| 5,963,759 | | 10/1999 | Kojima et al. | 399/111 |
| 6,016,408 | | 1/2000 | Hashimoto et al. | 399/27 |

* cited by examiner

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

An electrophotographic image forming apparatus for forming an image on a recording medium includes: a container mounting portion for attachable/detachably mounting a developer replenishing container having a developer containing portion containing a developer and a discharge port for discharging a developer contained in the developer containing portion, a cartridge mounting portion for attachable/detachably mounting a cartridge having a developing device for developing an electrostatic latent image formed on an electrophotographic photosensitive member using a developer, a developer containing portion for containing the developer used in developing with the developing device, and a developer receiving port for receiving a developer from the developer replenishing container to the developer containing portion, wherein the discharge port in the developer replenishing container and the developer receiving port in the cartridge are communicatively connected to each other in a state where the developer replenishing container and the cartridge are mounted within the electrophotographic image forming apparatus body.

14 Claims, 29 Drawing Sheets

ELECTROPHOTOGRAPHIC IMAGE FORMING APPARATUS DETACHABLY MOUNTING A DEVELOPER REPLENISHING CONTAINER OR IN WHICH A PLURALITY OF CARTRIDGES AND DEVELOPER REPLENISHING CONTAINERS ARE ATTACHABLY AND DETACHABLY POSITIONED

BACKGROUND OF THE INVENTION

1. Field of the Invention

The present invention relates to an electrophotographic image forming apparatus.

An electrophotographic image forming apparatus forms an image on a recording medium using an electrophotographic image forming process. Examples of electrophotographic image forming apparatus include an electrophotographic copier, an electrophotographic printer (an LED printer, a laser beam printer or the like), an electrophotographic facsimile device, an electrophotographic word processor, and the like.

2. Related Background Art

In an electrophotographic image forming apparatus using an electrophotographic image forming process, a process cartridge system has been conventionally adopted in which an electrophotographic photosensitive drum and process means, which acts on the electrophotographic photosensitive drum, are integrally formed as a cartridge and the cartridge is detachably mountable to a main body of an electrophotographic image forming apparatus. According to the process cartridge system, maintenance of the apparatus can be performed by not a service man but a user himself and the operability can be significantly improved. Thus, the process cartridge system has been widely used in the electrophotographic image forming apparatus.

Further, a cartridge configuration, in which the respective process means are formed as a cartridge has been realized. For example, a developing cartridge in which a toner containing portion and developing means are integrally formed, or a process cartridge, in which an electrophotographic photosensitive member, charging means and cleaning means are integrally formed or the like, has been adopted.

The demand for a color electrophotographic image forming apparatus capable of forming a color image has recently increased, Thus, the introduction of a color electrophotographic image forming apparatus which can attain the following six objectives is expected:

(1) a low running cost;

(2) a compact size;

(3) low power consumption;

(4) high-quality image production;

(5) a high speed; and (6) improved operability.

In these demands, for example, as a countermeasure for the item (1) a low running cost, a further increase in the life of the above-mentioned process means can be considered.

However, the amount of toner corresponding to the life of process means becomes an amount proportional to the life of the process means. For example, in a case where the life of process means is 50000 sheets of images, an amount of toner needed reaches 1.25 to 1.5 kg. When such a large amount of toner is integrally contained in a cartridge, the total weight and volume of the cartridge significantly become large and an operability may be lowered.

Further, since the space occupied by the entire cartridge is increased, miniaturization (downsizing) of the entire apparatus may become difficult. Further, a frame for supporting a cartridge with a large weight with high precision is needed and the total cost may increase.

The present invention has further advanced the above-mentioned conventional arts.

SUMMARY OF THE INVENTION

An object of the present invention is to provide an electrophotographic image forming apparatus in which a developer replenishing container containing a developer and a cartridge connectable to the developer replenishing container so as to allow the replenishment of the developer from the developer replenishing container can be each independently mounted in a main body of the electrophotographic image forming apparatus.

Another object of the present invention is to provide an electrophotographic image forming apparatus for forming an image on a recording medium, comprising: a container mounting means for attachably/detachably mounting a developer replenishing container having a developer containing portion for containing a developer and a discharge port for discharging the developer contained in the developer containing portion; and a cartridge mounting means for attachably/detachably mounting a cartridge having developing means for developing an electrostatic latent image formed on an electrophotographic photosensitive member using a developer, a developer containing portion for containing the developer to be used in developing with the developing means, and a developer receiving port for receiving the developer from the developer replenishing container into the developer containing portion, wherein the discharge port of the developer replenishing container and the developer receiving port of the cartridge are communicatively connected to each other in a state where the developer replenishing container and the cartridge are mounted in a main body of the electrophotographic image forming apparatus.

Another object of the present invention is to provide an electrophotographic image forming apparatus in which in a state where a developer replenishing container and a cartridge are mounted in a main body of the an electrophotographic image forming apparatus, a discharge port of the developer replenishing container and a developer receiving port of the cartridge are communicatively connected to each other so that the developer can be replenished from the developer replenishing container to the cartridge.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Embodiments of the present invention will be described with reference to the drawings.

In the following descriptions, the longitudinal direction of a process cartridge is defined as a direction along which a process cartridge is mounted in a main body of an electrophotographic image forming apparatus, and is a direction which intersects (substantially at a right angle) a conveying direction of a recording medium. The longitudinal direction of the process cartridge is the same as the axial direction of an electrophotographic photosensitive member. Further, the left and right directions in this description are defined as the left and right directions when looking in the conveying direction of the recording medium. Further, the upper and lower positions are defined as the upper and lower directions in a cartridge-mounted state.

Embodiment 1

(Explanation of the entire electrophotographic image forming apparatus)

First, the entire configuration of a color electrophotographic image forming apparatus according to an embodiment of the present invention will be schematically described with reference to FIG. 1.

Figure 1:
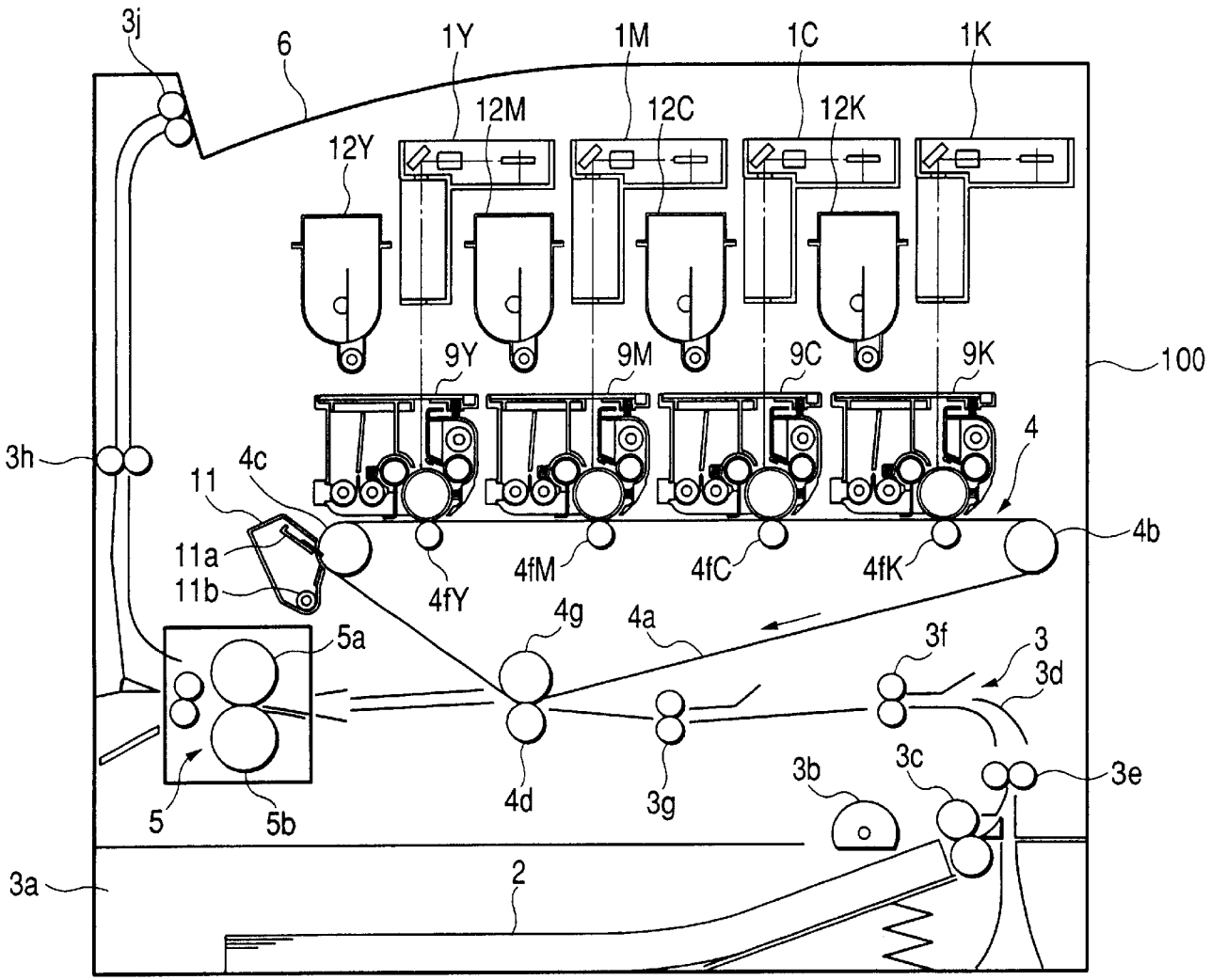
FIG. 1 is a cross-sectional view of an electrophotographic image forming apparatus of Embodiment 1.

FIG. 1 is an explanatory view showing the entire configuration of a color laser beam printer which is an embodiment of a color toner electrophotographic image forming apparatus.

An image forming portion of an electrophotographic image forming apparatus (a color laser beam printer) shown in this embodiment is formed in such a manner that four process cartridges 9Y, 9M, 9C, 9K (yellow, magenta, cyan, black) each having a drum-shaped electrophotographic photosensitive member 7 (referred to as "photosensitive drum" below) and exposure means 1Y, 1M, 1C, 1K (laser beam optical scanning systems) corresponding to the respective colors, positioned above the process cartridges 9Y, 9M, 9C, 9K are juxtaposed to each other.

Below the above-mentioned image forming portion, feeding means 3 for feeding a recording medium 2, an intermediate transfer belt 4*a* for transferring a toner image formed on the photosensitive drum 7, and a secondary transfer roller 4*d* for transferring a toner image on the intermediate transfer belt 4*a* onto the recording medium 2 are placed.

Also, fixing means 5 for fixing the recording medium 2 onto which a toner image has been transferred, and discharging means 3*h*, 3*j* for discharging and stacking the recording medium 2 out of the apparatus, are placed.

The recording medium 2 includes, for example, a paper, an OHP sheet, a cloth or the like.

The image forming apparatus of the present embodiment of a cleanerless system. Thus, toner remaining on the photosensitive drum 7 after transfer is carried in developing means 10 later described and a cleaner specifically used for collecting and reserving toner remaining after transfer is not provided in the process cartridges 9Y, 9M, 9C, 9K.

Configurations of the respective portions of the above-mentioned image forming apparatus will be, in turn, described.

(Feeding portion)

The feeding portion (feeding means) 3 feeds the recording medium 2 to the image forming portion and mainly includes a feed cassette 3*a* containing stacked sheets of recording medium 2, a feed roller 3*b*, an anti-double-feed retard roller 3*c*, a feed guide 3*d*, and a registration roller 3*g*.

The feed roller 3*b* is driven to rotate in accordance with an image forming operation and separates and feeds the recording medium 2 in the feed cassette 3*a* for every one sheet. The recording medium 2 is guided with the feed guide 3*d* and is conveyed to the registration roller 3*g* through conveying rollers 3*e*, 3*f*.

Just after the recording medium 2 is conveyed, the registration roller 3*g* is in a non-rotation mode. A skew feed of the recording medium 2 is corrected by hitting the leading end of the recording medium 2 to a nip portion of the registration roller 3*g*.

The registration roller 3*g* performs a non-rotary operation for allowing the recording medium 2 to rest/wait and a rotary operation for conveying the recording medium 2 to the intermediate transfer belt 4*a* at a given sequence during image formation and registers between the toner image (developer image) during a transfer step that is a next step and the recording medium 2.

(Process cartridge)

Figure 2:
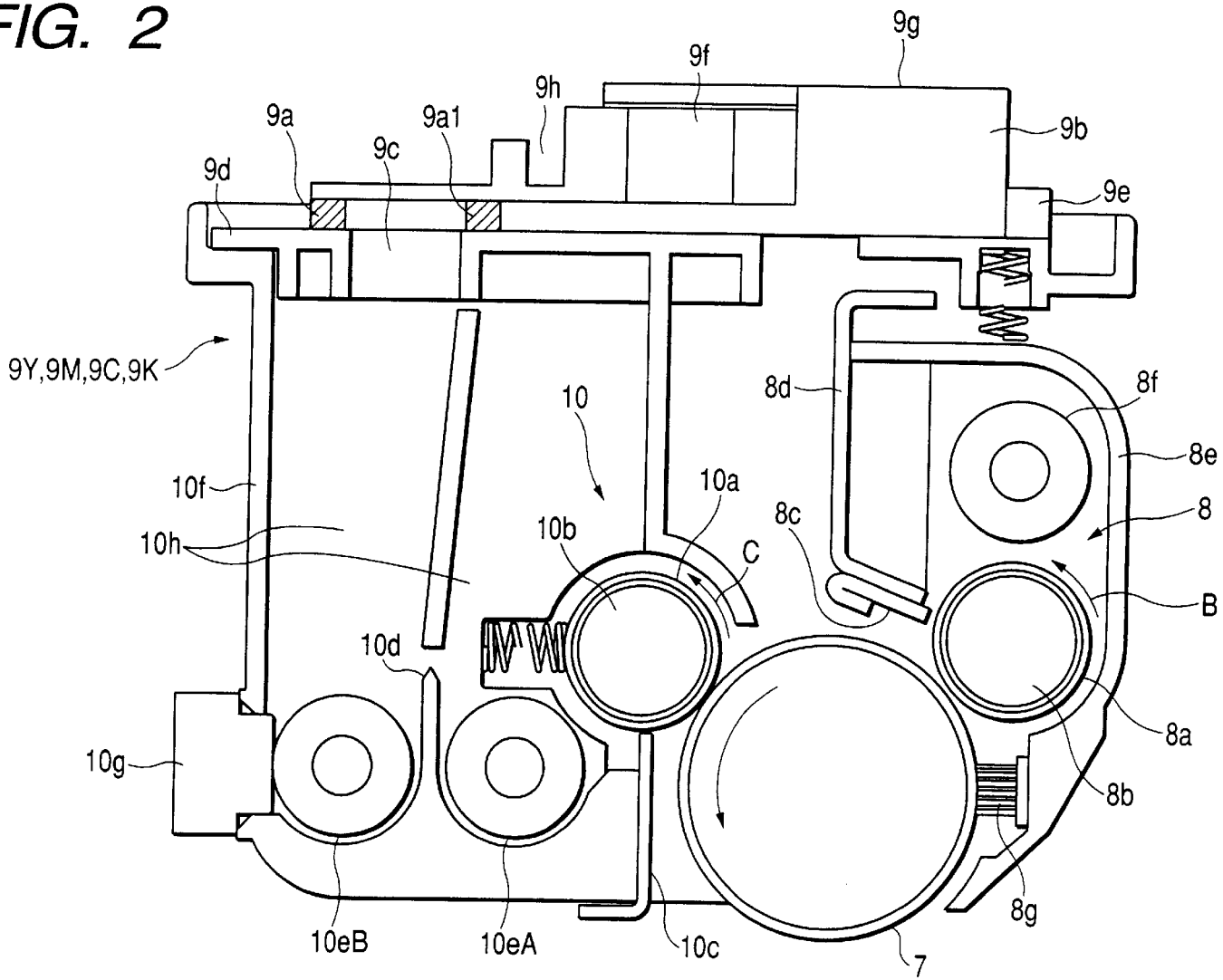
FIG. 2 is a cross-sectional view of a process cartridge of Embodiment 1.

In each of the process cartridges 9Y, 9M, 9C, 9K, the charging means 8 and the developing means 10 are placed around the photosensitive drum 7 as shown in FIG. 2 and they are integrally formed. The process cartridges 9Y, 9M, 9C, 9K can be easily detached by a user from the main body of the electrophotographic image forming apparatus (referred to as "apparatus body" below) 100 and when the photosensitive drum 7 is life-expired, it is replaced.

In the present embodiment, for example, the rotation number of the photosensitive drum 7 is counted, and when the number exceeds a given count number, an alarm indicates that the process cartridge is life-expired.

The photosensitive drum 7 in the present embodiment is of a negatively charged organic photoconductor. The photosensitive drum 7 has a photoconductive layer that is usually used, on an aluminum drum substrate having a diameter of about 30 mm and provides a charge injection layer on the outermost surface layer. And the photosensitive drum 7 is driven to rotate at a given process speed, about 117 mm/sec in this embodiment.

As the charge injection layer a coated layer of a material of an insulating resin binder into which, for example, $SnO_2$ ultra fine particles are dispersed as conductive fine particles is used.

A drum flange 7*b* is fixed to that side end portion of the photosensitive drum 7 (see FIG. 10), and a non-driving flange 7*d* is fixed to this side end portion. A drum shaft 7*a* is penetrated through the centers of the drum flange 7*b* and the non-driving flange 7*d*, and the drum shaft 7*a*, the drum flange 7*b* and the non-driving flange 7*d* are integrally rotated. That is, the photosensitive drum 7 is rotated about the axis of the drum shaft 7*a*.

This side end portion of the drum shaft 7*a* is rotatably supported with a bearing 7*e*. The bearing 7*e* is fixed to a bearing case 7*c*. And the bearing case 7*c* is fixed to a frame 9*d* of the process cartridges 9Y, 9M, 9C, 9K.

(Charging means)

A charging means uses a contact charging method. In this embodiment, a magnetic brush charging device 8 using magnetic particles is used as a charging member.

The charging member concretely has a magnetic brush portion which is formed by magnetically confining conductive magnetic particles. The charging of the photoconductor is carried out by allowing the magnetic brush portion to contact the photosensitive drum 7 and applying a voltage to the charging member.

Such a charging method (charging of a member to be charged by directly injecting charges) is referred to as "an injection charging". By using this injection charging method, a cleaner mechanism (cleaning blade, cleaning roller and the like) which mechanically scrapes off and removes toner remaining on the photosensitive drum 7 became unnecessary. This cleanerless system is described later.

The injection charging method of the present embodiment does not utilize the discharge phenomenon in which the charging to a member to be charged is carried out by the use of a corona charger. Accordingly, an applied charging bias required for charging is only a desired surface potential of a member to be charged, and the injection charging method is a perfect ozoneless type charging which does not generate ozone and a low power consumption type charging.

Next, the magnetic brush charging device 8 of the present embodiment will be described with reference to FIG. 2.

(Magnetic brush charging device)

The magnetic brush charging device 8 forms a magnetic brush layer of magnetic particles on a charging sleeve 8*a*, in which a magnet roller 8*b* is provided, and charges the photosensitive drum 7 to a desired potential through the contact portion of brush with the photosensitive drum 7.

The charging sleeve 8*a* is placed in such a manner that substantially a half left periphery of the charging sleeve 8*a* is protruded into an opening portion of a charging container 8*e* containing magnetic particles in the longitudinal direction and substantially a half right periphery of the charging sleeve 8*a* is exposed outside. Irregularities are formed on a surface of the charging sleeve 8*a* by appropriately making the surface rough so that feeding of magnetic particles can be satisfactorily carried out.

The magnet roller 8*b* provided within the charging sleeve 8*a* is four-pole polarized in the circumferential direction. And magnetic particles are adhered to the photosensitive drum 7 and in order to prevent the adhered magnetic particles from being carried during rotation of the drum, the magnet roller 8*b* is fixed so that one pole, specifically, a S1 pole is opposed to the central direction of the photosensitive drum 7.

A non-magnetic plate-shaped regulating blade 8*c* is placed with a given gap between this regulating blade 8*c* and the surface of the charging sleeve 8*a*. The regulating blade 8*c* is supported on the charging container 8*e* through a supporting metallic plate 8*d*. Magnetic particles are held by the magnet roller 8*b* and are fed in a direction indicated by the arrow B by a rotation of the charging sleeve 8*a*. And the magnetic particles form a magnetic brush portion having a predetermined thickness on the charging sleeve 8*a* by the regulating blade 8*c*.

The charging sleeve 8*a* is oppositely placed with a given gap with respect to the photosensitive drum 7. The magnetic brush contacts the surface of the photosensitive drum 7 to form a charged nip portion. The width of the charged nip portion influences the charging properties for the photosensitive drum 7. In the present embodiment, the gap is controlled so that the width of the charged nip portion is of about 6 mm.

The charging sleeve 8*a* is driven to rotate with a motor (not shown) in a direction indicated by the arrow B in FIG. 2, which is a counter direction at the opposed portion with respect to the photosensitive drum 7 that is a member to be charged. In the present embodiment, when the rotary speed of the photosensitive drum 7 is $V_1$, the charging sleeve 8*a* is rotated at a speed ratio of $V_2 \cong 1.5 \times V_1$ in the counter direction. The larger the relative rotary speed between the photosensitive drum 7 and the magnet brush portion becomes, the more the chance of contact increases. Accordingly, the charging uniformity is enhanced and the uptake properties of toner remaining after transfer to the magnetic brush can be enhanced.

To the magnetic brush portion is applied a desired charging bias from a charging bias power supply (not shown) through the charging sleeve 8*a*, and the surface of the photosensitive drum 7 is contact-charging treated to a desired polarity and potential in the charged nip portion.

As conductive magnetic particles forming the magnetic brush portion, magnetic metallic particles such as ferrite, magnetite and the like, and also such conductive magnetic particles bonded with resin can be used.

An agitating member 8*f* is rotatably supported between wall surfaces of both ends of the charging container 8*e* in the longitudinal direction so that it is placed substantially parallel with the charging sleeve 8*a* and above the charging sleeve 8*a*.

A charging brush 8*g* contacts the surface of photosensitive drum 7 at an inroad amount of about 1 mm and applies a desired voltage thereto. By the contact of the charging brush 8*g*, the toner remaining on the surface of the photosensitive drum 7 is uniformly dispersed, and a residual charge elimination is further performed, whereby the charging of the next step is uniformly carried out.

Next, a cleanerless system in the reversal developing system in which the photosensitive member is negatively charged and the negatively charged toner is developed on a lower potential portion of an exposure portion will be described.

(Cleanerless system)

First, particularly, a positively charged toner among the toner slightly remaining after transfer on the photosensitive member is once electrostatically drawn in the magnetic brush charging device 8 and toner other than the above-mentioned toner is also collected by forcible scraping using a brush. And after the toner is negatively charged by friction with magnetic particles in the magnetic brush charging device 8, the toner is vomited onto the photosensitive drum 7.

On the other hand, the toner remained negatively charged among the toner remaining after transfer is not almost drawn in the magnetic brush charging device 8 and is collected in the developing device 10 together with toner vomited from the magnetic brush charging device 8 (cleaning simultaneous with developing).

The drawing of toner into the developing device 10 in the cleaning simultaneous with developing is carried out by the fog removal bias (the fog removal potential difference is the potential difference between the direct current voltage applied to the developing device 10 and the surface potential of the photosensitive drum 7).

According to this method, since a part of the toner remaining after transfer is via the magnetic brush charging device 8 collected and the remainder is directly collected in the developing device 10 so that the toner remaining after transfer is used in the next step and thereafter, the elimination of waste toner becomes possible and the inconvenience of maintenance can be decreased. Further, a cleanerless system uses less space, whereby the image informing apparatus can be significantly reduced in size.

(Exposure means)

In the present embodiment, exposure to the above-mentioned photosensitive drum 7 is carried out by the use of laser exposure means 1Y, 1M, 1C, 1K. That is, when an image signal is transmitted from the apparatus body 100, a laser beam L modulated in response to this signal is applied to the uniformly charged surface of the photosensitive drum 7 by scanning (see FIG. 6). And an electrostatic latent image corresponding to the image information is selectively formed on the surface of the photosensitive drum 7.

Each of the laser exposure means 1Y, 1M, 1C, 1K is composed of a solid-state laser element (not shown), a polygon mirror 1*a*, an imaging lens 1*b*, a reflective mirror 1*c* and the like. The solid-state laser element is ON/OFF light emission controlled at a desired timing with an light emission signal generator (not shown) based on the inputted image signal. The laser beam L emitted from the solid-state laser element is converted into a substantially parallel beam with a collimator lens system (not shown) and is scanned with the polygon mirror 1*a* which is rotated at a high speed. And the beam is imaged on the photosensitive drum 7 in a spot shape through the imaging lens 1*b* and the reflective mirror 1*c*.

Thus, the laser beam scanning exposure in the main scanning direction and the exposure in the sub-scanning direction due to the rotation of the photosensitive drum 7 are applied onto the surface of the photosensitive drum 7 to thereby obtain an exposure distribution in accordance with the image signal.

That is, by the irradiation and non-irradiation of laser beam L are generated a surface potential, a reduced highlight potential, and a surface potential non-reduced shadow potential, respectively. And by contrast between the highlight potential and the shadow potential an electrostatic latent image corresponding to the image information is formed.

(Developing means)

The developing device 10, which is developing means, is a two-component contact developing device (two-component magnetic brush developing device) and holds a developer composed of a carrier and a toner on a developing sleeve 10*a*, which is a developer bearing member, in which a magnet roller 10*b* is provided. The developing sleeve 10*a* is provided with a regulating blade 10*c* with a desired gap therebetween. By the rotation of the developing sleeve 10*a* in a direction indicated by an arrow C, a thin layer of the developer is formed on the developing sleeve 10*a*. The regulating blade 10*c* is supported and fixed to a developing container 10*f*.

The developing sleeve 10*a* is set in such a manner that it is placed in parallel so as to have a desired gap between the developing sleeve 10*a* and the photosensitive drum 7 and in such a manner that during developing, a developer formed on the developing sleeve 10*a* can develop in a state where the developer contacts the photosensitive drum 7. The developing sleeve 10*a* is driven to rotate at a desired peripheral speed in a counterclockwise indicated by an arrow, which is a counter direction to the rotation direction of the photosensitive drum 7 in the developing portion.

The toner used in the present embodiment is a negatively charged toner with an average particle diameter of 6 $\mu$m. As a magnetic carrier, a magnetic carrier having a saturated magnetization of 205 emu/cm$^3$ and an average particle diameter of 35 $\mu$m is used. Further, as a developer, a mixture of toner and carrier mixed at the weight ratio of 6:94 is used.

Figure 10:
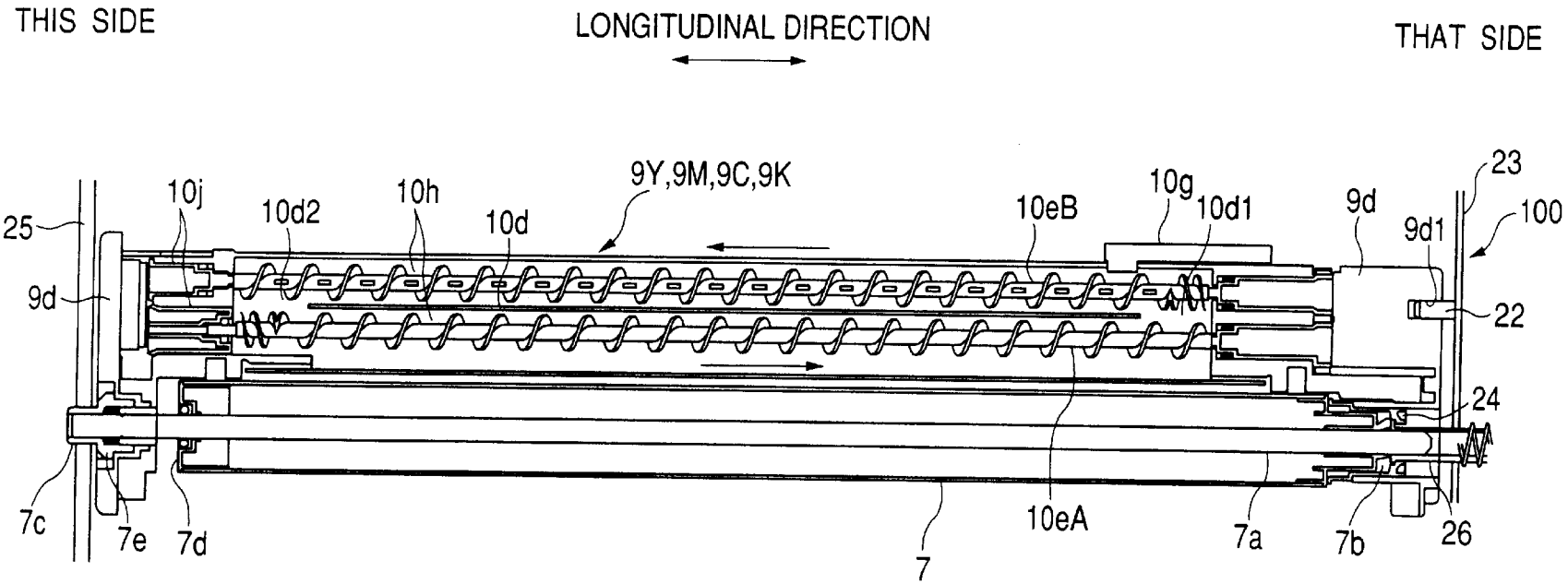
FIG. 10 is a longitudinal cross-sectional view of the process cartridge of Embodiment 1.

A developer containing portion 10*h* in which a developer is circulated is divided into two portions with a partition wall 10*d* extending in the longitudinal direction except for both end portions of the developer containing portion 10*h*, as shown in FIGS. 2 and 10. And agitating screws 10*e*A, 10*e*B are placed so as to sandwich the partition wall 10*d*. The agitating screws 10*e*A, 10*e*B are rotatably supported on both side surfaces of the frame 9*d* of each of the process cartridges 9Y, 9M, 9C, 9K through bearings 10*j*.

The toner replenished from toner replenishing containers 12Y, 12M, 12C, 12K used as the developer replenishing containers falls down on this side of the agitating screw 10*e*B and is agitated while being fed to that side in the longitudinal direction and is passed through a portion 10*d*1 without the partition wall 10*d* on that side end. Then the toner is further fed to this side in the longitudinal direction with the agitating screw 10*e*A and is passed through a portion 10*d*2 without the partition wall 10*d* on this side and is agitated while being fed with the agitating screw 10*e*B. Thus, the circulation is repeated.

Developing steps of visualizing an electrostatic latent image formed on the photosensitive drum 7 by the two-component magnetic brush process using the developing device 10 and the circulation system of developer will be described.

By the rotation of the developing sleeve 10*a*, a developer in a developing container 10*f* is drawn to the surface of the developing sleeve 10*a* with the N3 pole of the magnet roller 10*b* and is fed.

In the process of feeding the developer, the layer thickness of developer is regulated with the regulating blade 10*c* placed vertically to the developing sleeve 10*a*, and a thin layered developer is formed on the developing sleeve 10*a*. When the thin layered developer is fed to a developing pole, the N1 pole corresponding to the developing portion, a magnetic brush is formed by magnetic force. An electrostatic latent image on the surface of the photosensitive drum 7 is developed by toner in a developer which stands like the ears of rise as a toner image. The electrostatic latent image is developed while reversed in the present embodiment.

A thin layered developer on the developing sleeve 10*a*, which has passed through the developing portion is subsequently fed into the developing container 10*f* by the rotation of the developing sleeve 10*a* and is left from the surface of the developing sleeve 10*a* by the repulsion magnetic field in the N2 pole and the N3 pole to return to a developer reservoir in the developing container 10*f*.

A direct current (DC) voltage and an alternating current (AC) voltage are applied from a power supply (not shown) to the developing sleeve 10*a*. In the present embodiment a DC voltage of −500 V and an AC voltage of peak-to-peak voltage of 1500 V at the frequency of 2000 Hz are applied to selectively develop only the exposed portion of photosensitive drum 7.

When the AC voltage is applied in the two-component developing process, the developing efficiency is generally increased to obtain an image having high quality. However, there arises a fear that fogging may easily occur. Therefore, prevention of the fogging is usually realized by providing the potential difference between the DC voltage applied to the developing sleeve 10*a* and the surface potential of the photosensitive drum 7. More specifically, the bias voltage of a potential difference between the potential of the exposed portion and the potential of the non-exposed portion of the photosensitive drum 7 is applied.

The potential difference for preventing fogging is called a fogging removal potential ($V_{back}$). By the potential difference, adhesion of toner to a non-image area (non-exposed portion) of the surface of the photosensitive drum 7 can be prevented during developing and the residual toner remaining on the surface of the photosensitive drum 7 after transfer is collected in the cleanerless system device (cleaning simultaneous with developing).

When toner is consumed by developing, the toner density in a developer is decreased. In the present embodiment a sensor 10*g* which detects the toner density is placed at a position in the vicinity of the outer periphery surface of the agitating screw 10*e*B. When the sensor 10*g* detects that the toner density in the developer is further decreased than a desired density level, an instruction to replenish toner from the toner replenishing containers 12Y, 12M, 12C, 12K to the developing device 10 is issued. By this toner replenishing operation the toner density in the developer can be always maintained and controlled at a desired level.

(Toner replenishing container)

The configuration of a toner replenishing container according to the present embodiment will be described with reference to FIG. 1, FIG. 3, FIG. 5, FIG. 8, FIG. 9 and FIG. 11.

Figure 11:
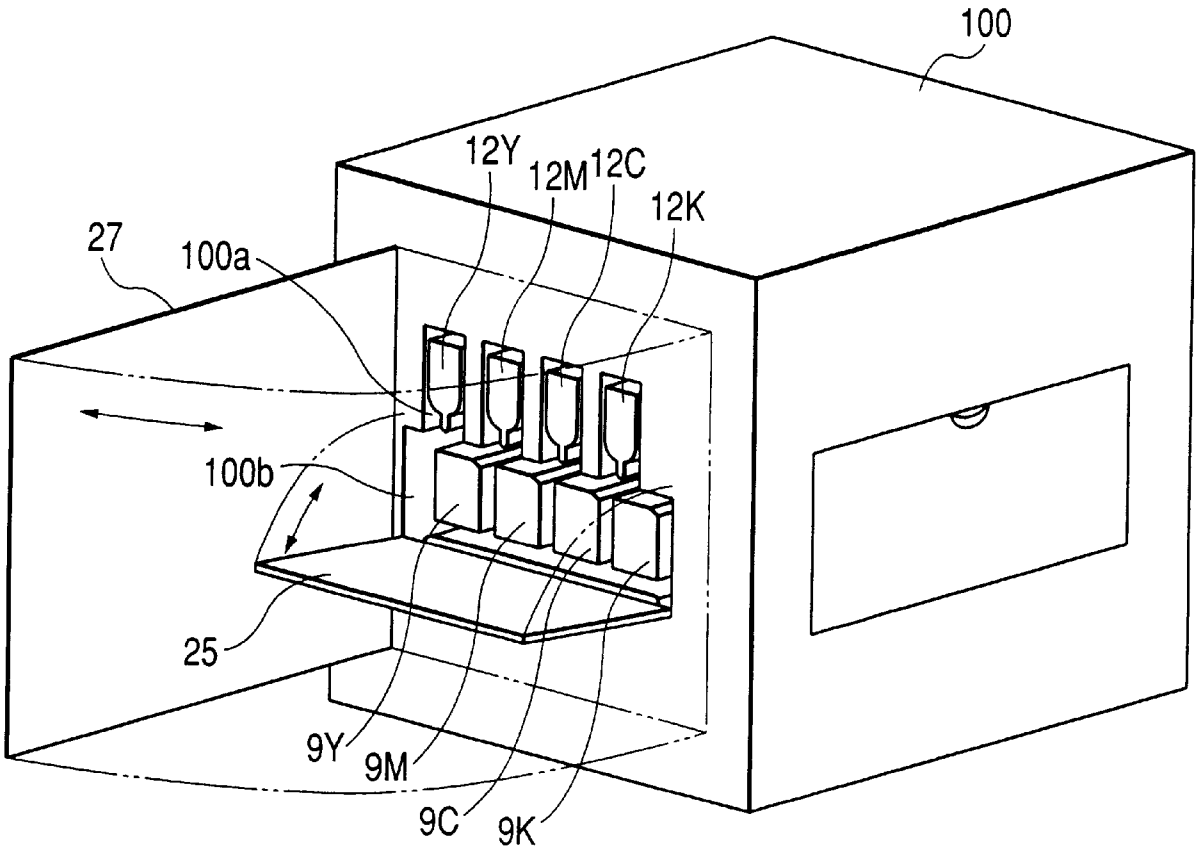
FIG. 11 is a schematic external perspective view of a main body of the electrophotographic image forming apparatus of Embodiment 1.

The toner replenishing containers 12Y, 12M, 12C, 12K are placed above the process cartridges 9Y, 9M, 9C, 9K in parallel to each other and are mounted from the front side of the apparatus body 100 (see FIG. 11).

Figure 3:
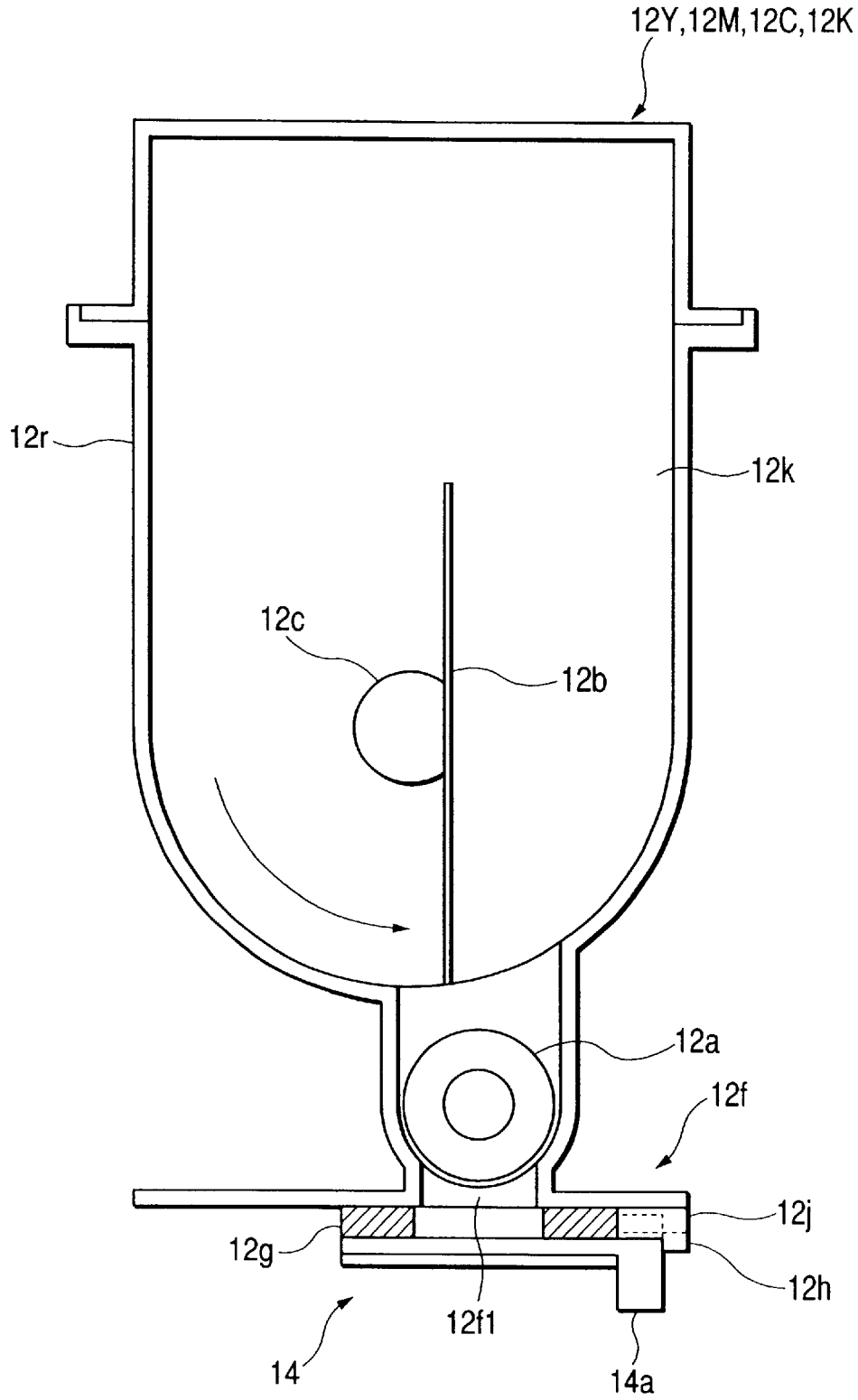
FIG. 3 is a cross-sectional view of a toner replenishing container of Embodiment 1.

Each of the toner replenishing containers 12Y, 12M, 12C, 12K has a toner containing portion 12*k* used as a developer containing portion, which contains toner in a frame 12*r*, as shown in FIG. 3. In the toner containing portion 12*k* are placed an agitating plate 12*b* used as a feeding member and fixed to an agitating shaft 12*c*, and a screw 12*a* used as a rotary member. And a discharge port portion 12*f* used as a discharge port and having a port 12*f*1 for discharging toner is formed on the bottom of the container. The screw 12*a* and the agitating shaft 12*c* are rotatably supported with bearings 12*d* in both ends thereof. A drive coupling (concave) 12*e* is placed on the one tip end. The drive coupling (concave) 12*e* receives driving transmission from a drive coupling (convex) 24 of the apparatus body 100 and is driven to rotate.

Figure 9:
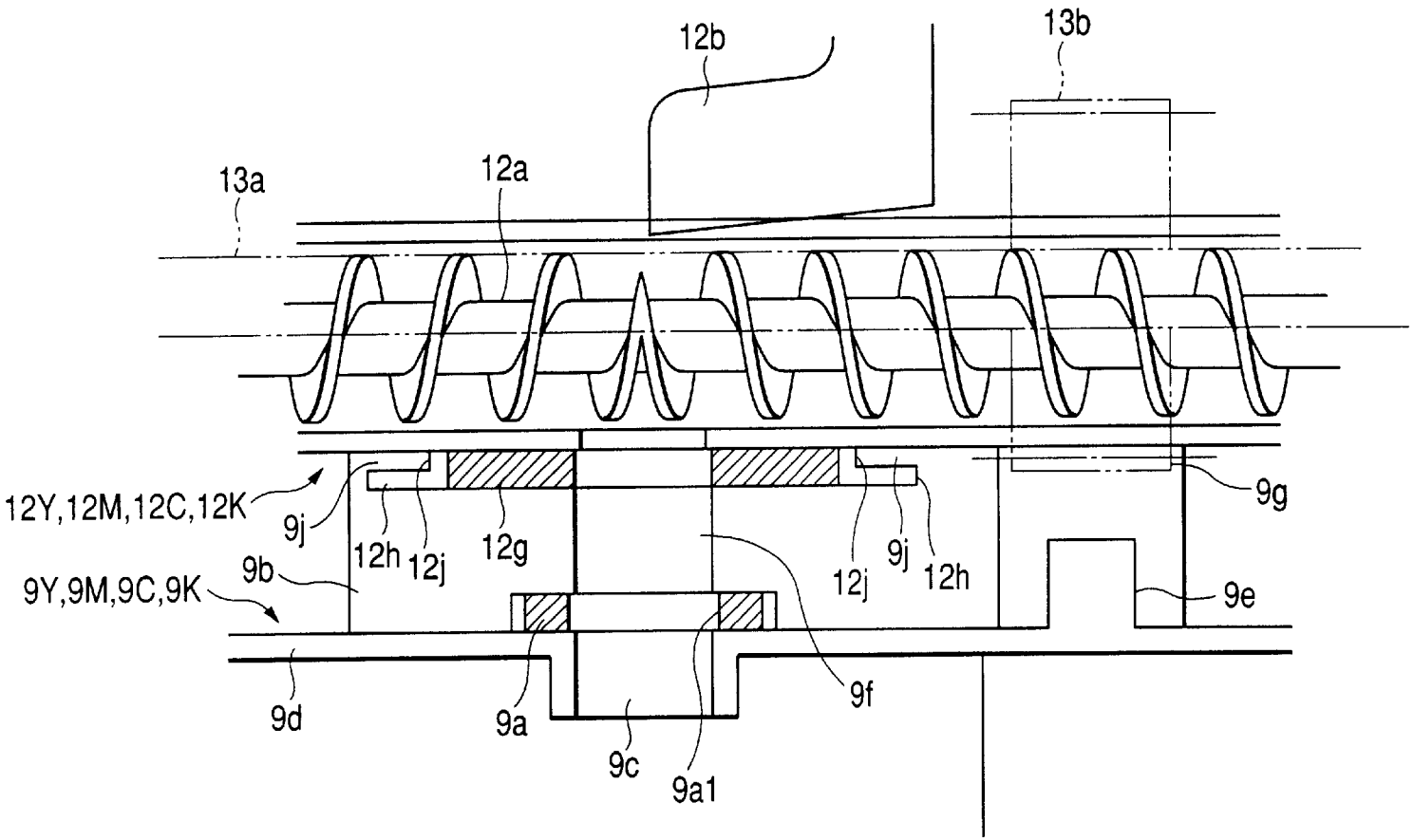
FIG. 9 is a detail (enlarged view of FIG. 8) of an open state of a cartridge opening and closing member and a toner replenishing container opening and closing member.

The outside portion of the screw 12*a* has a spiral lib shape and the twist direction of the spiral shape is reversed while setting the discharge port portion 12*f* as the center (see FIG. 9). By the rotation of the drive coupling (convex) 24, the screw 12*a* is rotated in a desired rotational direction. Toner is then fed toward the discharge port portion 12*f* and freely falls down from the port of the discharge port portion 12*f*, to thereby replenish toner in each of the process cartridges 9Y, 9M, 9C, 9K.

Figure 8:
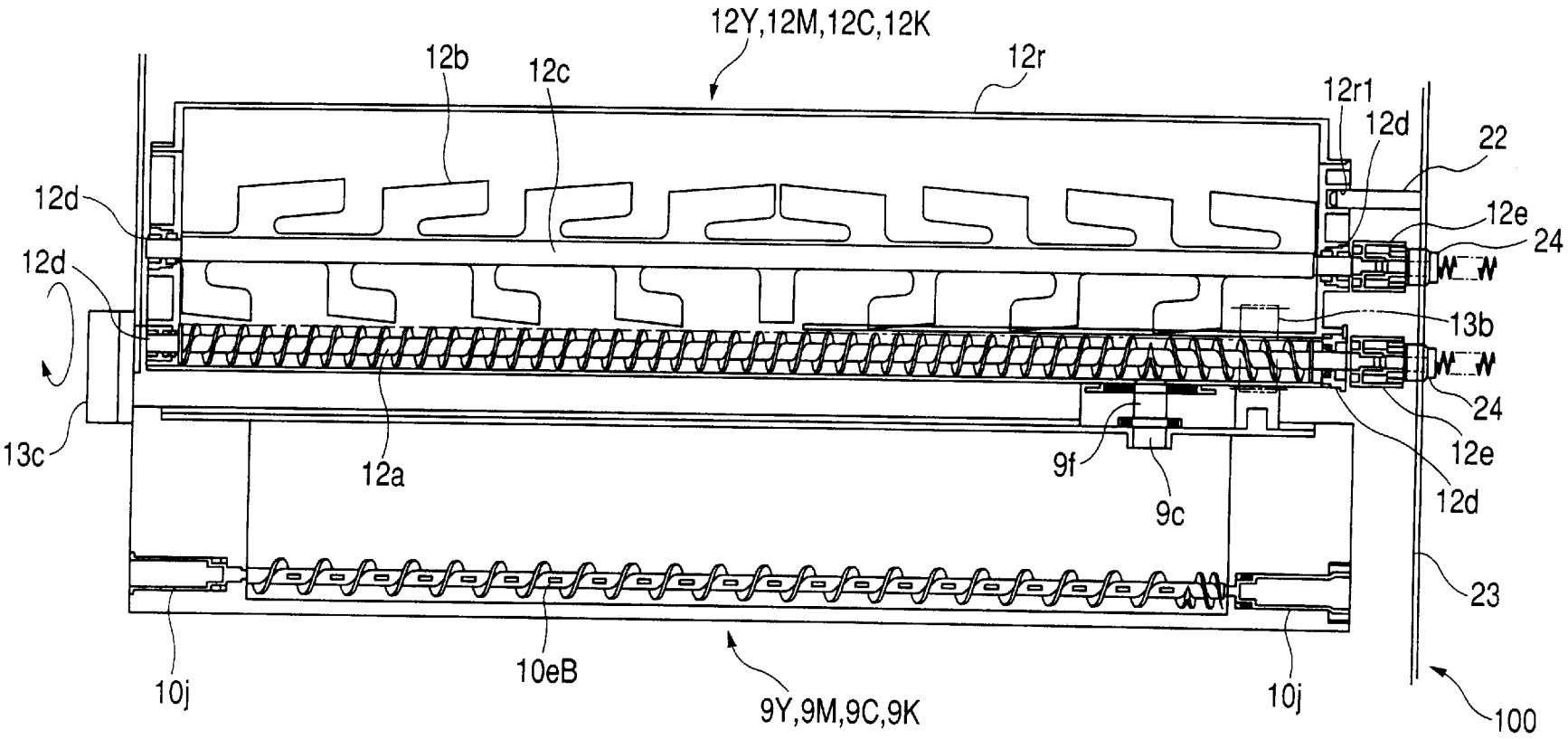
FIG. 8 is a longitudinal cross-sectional view of an engagement state (open state) between the process cartridge and the toner replenishing container of Embodiment 1.

The distal end of the agitating plate 12*b* in the radial direction of rotation is slanted (see FIG. 8). When the distal end is brought into contact with the inner wall surface (the inner wall surface of a toner containing portion 12*k*) of each of the toner replenishing containers 12Y, 12M, 12C, 12K, it contacts the surface at an angle. Specifically, the distal end side of the agitating plate 12*b* is twisted to become spiral-shape. Thus, by the twist inclination on the distal end side of the agitating plate 12*b* is generated the feeding force in the axial direction of the agitating shaft 12*c* so that toner is fed in the longitudinal direction.

(Transfer means)

An intermediate transfer unit 4, which is a transfer means, secondarily transfers a plurality of toner images collectively, which have been sequentially primarily transferred from the photosensitive drums 7 and superimposed on one another to the recording medium 2. As shown in FIG. 1, the intermediate transfer unit 4 is provided with an intermediate transfer belt 4*a* running in a direction indicated by an arrow, and the intermediate transfer belt 4*a* runs clockwise at a peripheral speed substantially the same as the outer peripheral speed of the photosensitive drum 7. The intermediate transfer belt 4*a* is an endless belt with a circumferential length of about 940 mm, and is extended around three rollers of a drive roller 4*b*, a secondary transfer opposed roller 4*g*, and a driven roller 4*c*. Further, transfer charging rollers 4*f*Y, 4*f*M, 4*f*C, 4*f*K are rotatably placed at positions respectively opposed to the photosensitive drums 7 and are pressurized in the respective central directions of the photosensitive drums 7.

The transfer charging rollers 4*f*Y, 4*f*M, 4*f*C, 4*f*K are energized from a high voltage power supply (not shown) to perform charging with polarity opposite to that of toner from the back side of the intermediate transfer belt 4*a* and primarily transfer the toner images on the photosensitive drums 7 to the upper surface of the intermediate transfer belt 4*a* sequentially.

A secondary transfer roller 4*d*, which is used as a transfer member, is in press-contact with the intermediate transfer belt 4*a* at a position opposed to the secondary transfer opposed roller 4*g* in the secondary transfer portion. The secondary transfer roller 4*d* can perform up-and-down motion in FIG. 1 and is also rotated. At this time bias is simultaneously applied to the secondary transfer roller 4*d*, so that the toner image on the intermediate transfer belt 4*a* is transferred to the recording medium 2.

In this step the intermediate transfer belt 4*a* and the secondary transfer roller 4*d* are respectively driven. When the recording medium 2 enters the secondary transfer portion, a given bias is applied to the secondary transfer roller 4*d* and the toner image on the intermediate transfer belt 4*a* is secondarily transferred to the recording medium 2.

While the secondary transfer with the recording medium sandwiched between the intermediate transfer belt 4*a* and the secondary transfer roller 4*d* is performed, the recording medium is fed at a given speed leftward in the drawing to a fixing device 5, which is the next step.

At a given position on the intermediate transfer belt 4*a* on the most downstream side in the transfer process is provided a cleaning unit 11 contactable with and separable from the surface of the intermediate transfer belt 4*a*. The cleaning unit 11 removes toner remaining after the secondary transfer.

A cleaning blade 11*a* for removing the toner remaining after the secondary transfer is placed in the cleaning unit 11. The cleaning unit 11 is swingably mounted at the rotation center (not shown). The cleaning blade 11*a* is in press-contact with the intermediate transfer belt 4*a* in an inroading direction. The transfer residual toner drawn into the cleaning unit 11 is fed to a waste toner tank (not shown) with a feeding screw 11*b* to be stored therein.

As the intermediate transfer belt 4*a*, an intermediate transfer belt made of polyimide resin can be used. The material of the intermediate transfer belt 4*a* is not limited to the polyimide resin, and plastics such as polycarbonate resin, polyethylene terephthalate resin, polyvinylidene fluoride resin, polyethylene naphthalate resin, polyether ether ketone resin, polyether sulfone resin, and polyurethane resin, and fluorine series rubber and silicone series rubber can be preferably used.

(Fixing portion)

A toner image formed on the photosensitive drum 7 with the developing means 10 is transferred to the recording medium 2 through the intermediate transfer belt 4*a*. Then the fixing device 5 fixes the toner image transferred to the recording medium 2 with heat.

As shown in FIG. 1, the fixing device 5 is provided with a fixing roller 5*a* for imparting heat to the recording medium 2 and a pressure roller 5*b* for press-contacting the recording medium 2 with the fixing roller 5*a*. Each of the rollers 5*a*, 5*b* is a hollow roller and has a heater (not shown) therein. The rollers are driven and rotated to feed the recording medium simultaneously.

That is, the recording medium 2 holding the toner image is fed with the fixing roller 5*a* and the pressure roller 5*b* and at the same time the toner image is fixed to the recording medium 2 by applying heat and pressure. The fixed recording medium 2 is discharged through discharge rollers 3*h*, 3*j* and is stacked on a tray 6 on the apparatus body 100.

(Mounting of process cartridge and toner replenishing container)

Next, mounting procedures of the process cartridge and the toner replenishing container will be described with reference to FIG. 6, FIG. 8, FIG. 10 and FIG. 11.

As shown in FIG. 11, an openable front door 27 is provided in the front of the apparatus body 100. The front door 27 is openable and closable in a direction indicated by the double-headed arrow. When the front door 27 is opened on this side, ports 100*a*, 100*b* for separately inserting the process cartridges 9Y, 9M, 9C, 9K and the toner replenishing containers 12Y, 12M, 12C, 12K are exposed.

A pivotably supported centering plate 25 is placed on the port 100*b* for inserting the process cartridges 9Y, 9M, 9C, 9K. The centering plate 25 is pivotable in a direction indicated by the double-headed arrow. When the process cartridges 9Y, 9M, 9C, 9K are inserted or removed, the centering plate 25 is first opened before the insertion or the removal.

Figure 6:
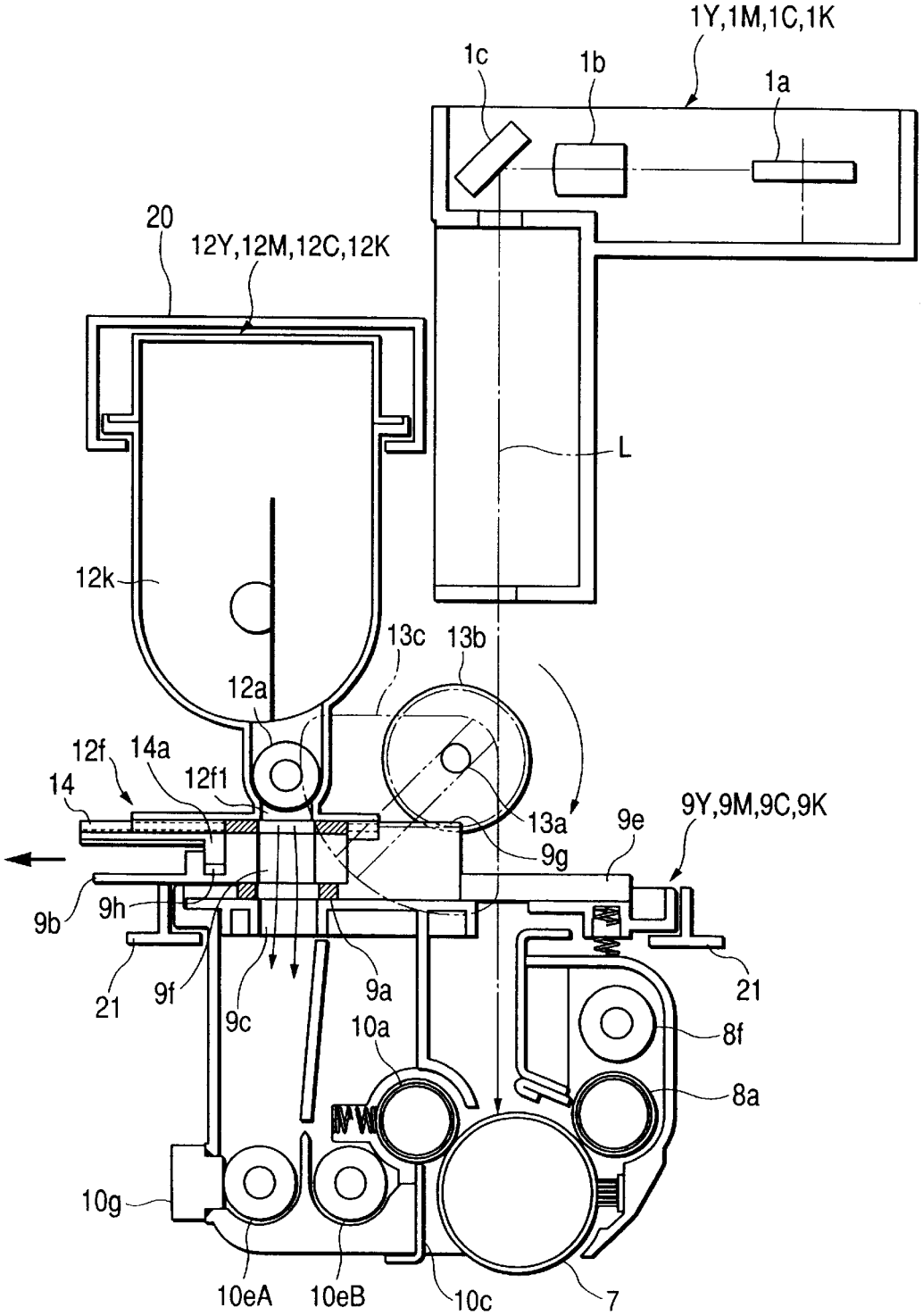
FIG. 6 is a cross-sectional view of an engagement state (open state) between the process cartridge and the toner replenishing container of Embodiment 1.

In the apparatus body 100, as shown in FIG. 6, guide rails 21 which are used as cartridge mounting means serving as a guide for detachably mounting the process cartridges 9Y, 9M, 9C, 9K, and a guide rail 20 which is used as container mounting means serving as a guide for detachably mounting the toner replenishing containers 12Y, 12M, 12C, 12K, are fixed.

A direction of mounting the process cartridges 9Y, 9M, 9C, 9K is parallel to the axial direction of the photosensitive drum 7, and a direction of mounting the toner replenishing containers 12Y, 12M, 12C, 12K is parallel to the axial direction of the screw 12*a*. The guide rails 21, 20 are placed in the same direction as the mounting direction. The process cartridges 9Y, 9M, 9C, 9K and the toner replenishing containers 12Y, 12M, 12C, 12K are slid and inserted from this side in the apparatus body 100 to that side along the guide rails 21, 20.

When the process cartridges 9Y, 9M, 9C, 9K are completely inserted into that side, the drum shaft 7*a* on that side end is inserted into a centering shaft 26 of the apparatus body 100, and the center position of rotation on that side of the photosensitive drum 7 is determined with respect to the apparatus body 100. At the same time, a drum flange 7*b* and a drive coupling (convex) 24 are connected to each other so that the photosensitive drum 7 can be driven and rotated. Further, a support pin 22 for positioning the process cartridges 9Y, 9M, 9C, 9K is arranged on a back side plate 23. This support pin 22 is inserted into a concave portion 9*d*1 provided on the frame 9*d* of the process cartridges 9Y, 9M, 9C, 9K so that the position of the frame 9*d* of each of the process cartridges 9Y, 9M, 9C, 9K is fixed.

The pivotable centering plate 25 is placed on this side of the apparatus body 100. A bearing case 7*c* of each of the process cartridges 9Y, 9M, 9C, 9K is supported and fixed to this centering plate 25. By such a series of inserting operations, the photosensitive drums 7 and the process cartridges 9Y, 9M, 9C, 9K can be positioned with respect to the apparatus body 100.

Therefore, the drum shaft 7*a*, drum flange 7*b*, concave portion 9*d*1, and bearing case 7*c* form a positioning portion for positioning each of the process cartridges 9Y, 9M, 9C, 9K with respect to the apparatus body 100.

On the other hand, when the toner replenishing containers 12Y, 12M, 12C, 12K are completely inserted to that side as shown in FIG. 8, the support pin 22 protruding from the back side plate 23 is inserted into a concave portion 12*r*1 provided on that side wall surface of a frame 12*r*, whereby the position of the frame 12*r* of the toner replenishing containers 12Y, 12M, 12C, 12K is fixed. At the same time, a drive coupling (concave) 12*e* and the drive coupling (convex) 24 are connected to each other and the screw 12*a* and the agitating shaft 12*c* can be driven and rotated.

Figure 30:
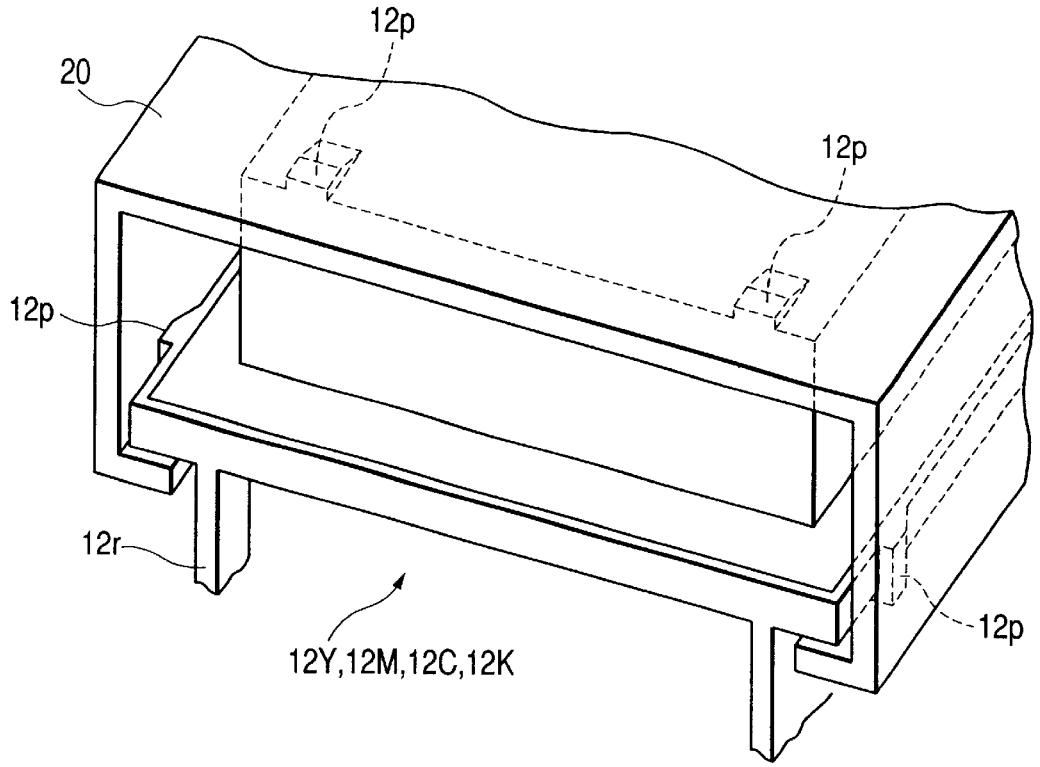
FIG. 30 is a schematic perspective view of positioning of the toner replenishing container of Embodiment 1.
Figure 31:
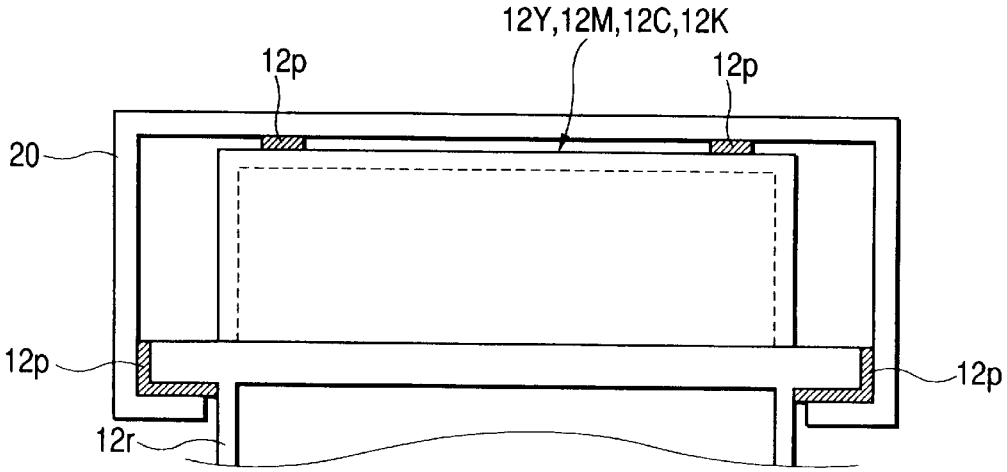
FIG. 31 is a schematic view of positioning of a toner replenishing container of Embodiment 1.

Further, as shown in FIGS. 30 and 31, a plurality of protrusions 12*p* are formed on this side wall surface of the frame 12*r* of each of the toner replenishing containers 12Y, 12M, 12C, 12K. These protrusions 12*p* engage with the inner wall of the opening portion of the guide rail 20. And the engagement of the opening portion of the guide rail 20 with the protrusions 12*p* determines this side position of the toner replenishing containers 12Y, 12M, 12C, 12K.

Therefore, the support pin 22, the drive coupling (concave) 12*e*, and the protrusions 12*p* form a positioning portion for positioning the toner replenishing containers 12Y, 12M, 12C, 12K with respect to the apparatus body 100.

(Explanation of the structure for replenishing toner)

Figure 23:
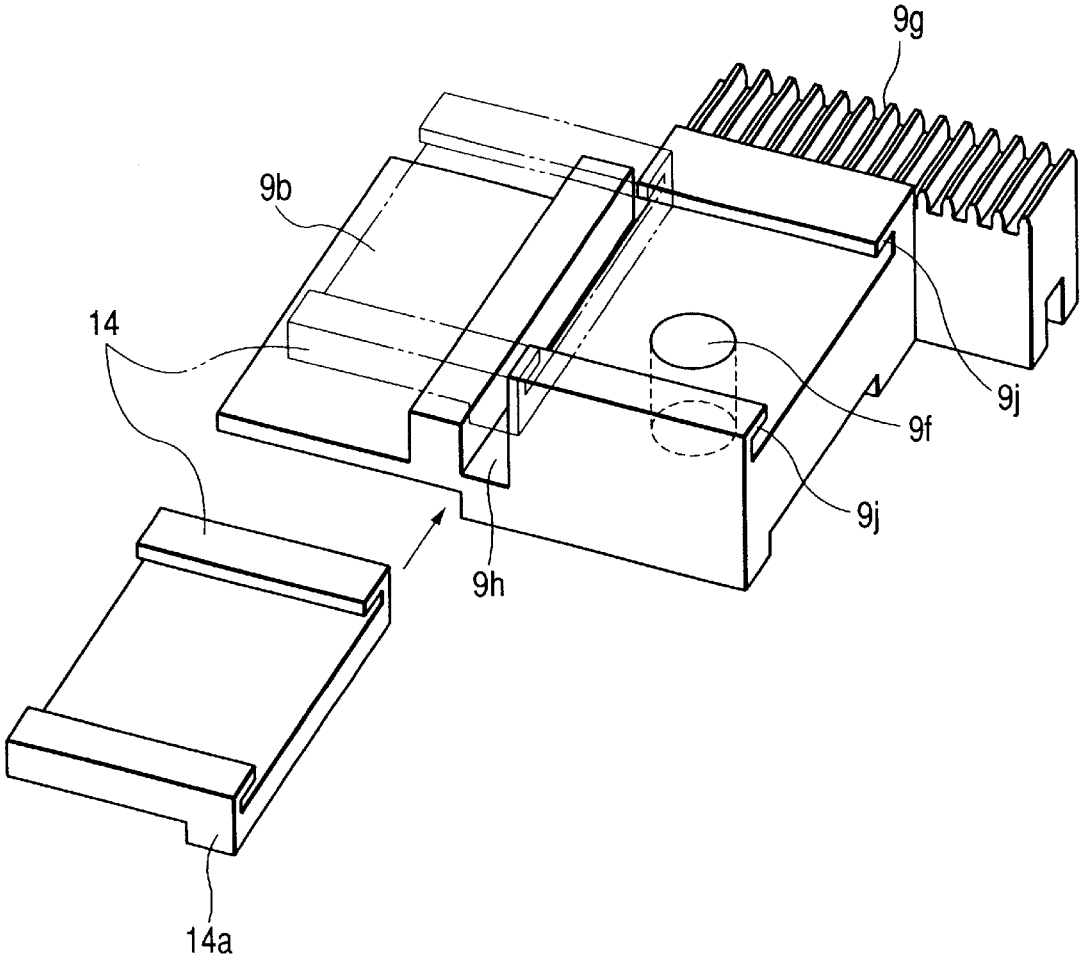
FIG. 23 is an explanatory view of a state before the engagement of a cartridge opening and closing member, and a toner replenishing container opening and closing member.

First, configurations of a replenishing port portion of the process cartridge and the cartridge opening and closing member will be described with reference to FIG. 2, FIG. 4, FIG. 19. FIG. 20, and FIG. 23.

Figure 4:
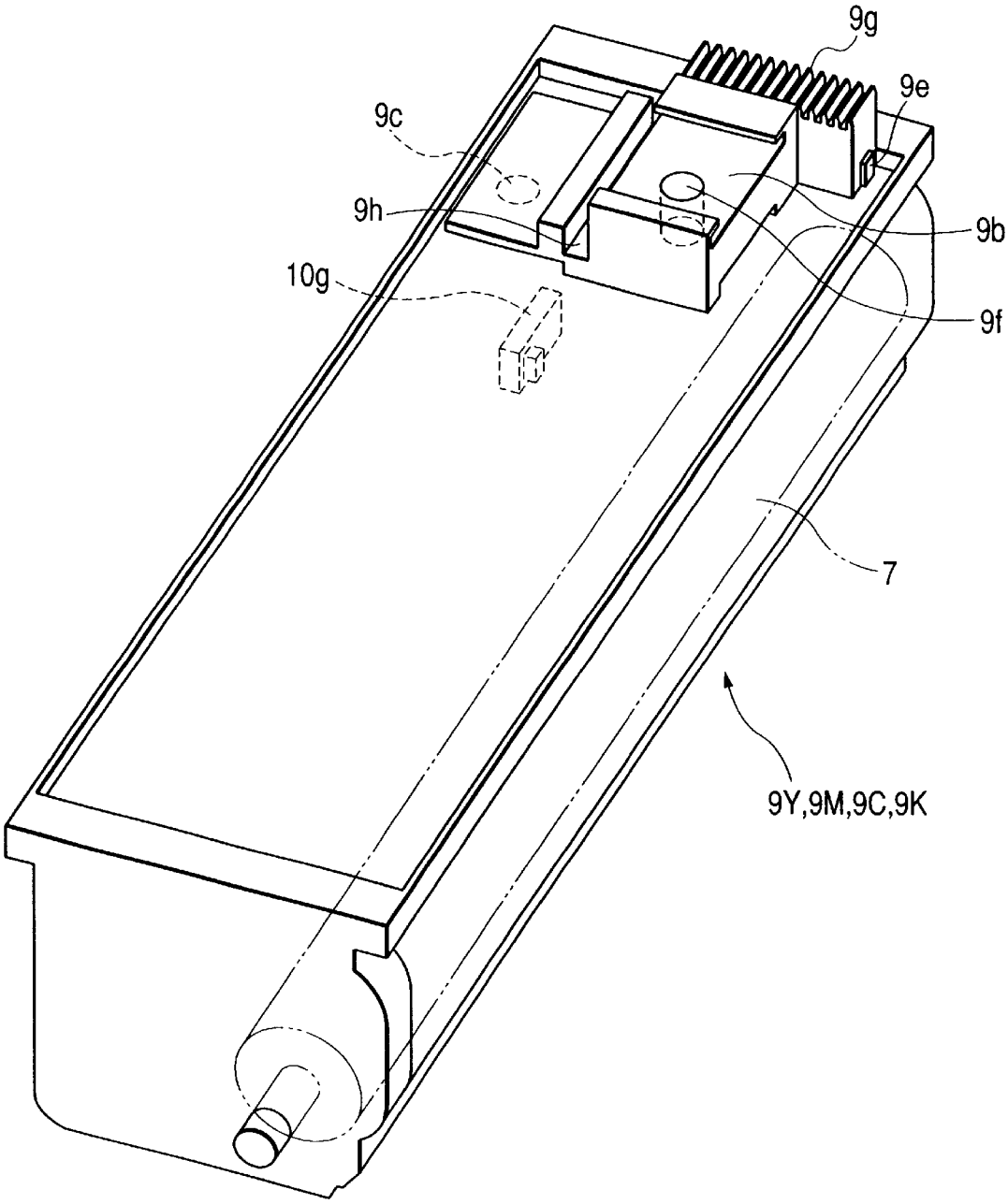
FIG. 4 is a schematic external perspective view of the process cartridge of Embodiment 1.

As shown in FIG. 2 and FIG. 4, on the upper surface of a frame 9*d* forming a part of each of the process cartridges 9Y, 9M, 9C, 9K is placed a replenishing port portion 9*c* which is used as an developer receiving port or an opening for receiving toner from the toner replenishing containers 12Y, 12M, 12C, 12K. In this embodiment the replenishing port portion 9*c* is placed on that side (near the forefront) in a direction of inserting the process cartridges 9Y, 9M, 9C, 9K, that is on the drive transmission side of the photosensitive drum 7.

In the periphery of the replenishing port portion 9*c*, a sealing member 9*a* is adhered and fixed to the upper surface of the frame 9*d*. In the sealing member 9*a* an opening 9*a*1 having the same shape of the replenishing port portion (opening) 9*c* is formed. A guide rib 9*e* and a cartridge opening and closing member 9*b* are placed on the frame 9*d* on the drive input side for driving the developing device 10 (on that side in the direction of inserting the process cartridge). The guide rib 9*e* is extended in a direction perpendicular to the axial direction of the developing sleeve 10*a*. The cartridge opening and closing member 9*b* slidably engages with the guide rib 9*e*.

Before use of the process cartridges 9Y, 9M, 9C, 9K, the sealing member 9*a* for the replenishing port portion 9*c* closely contacts to the cartridge opening and closing member 9*b* and the opening 9*a*1 is closed (see FIG. 2).

The first cartridge engagement portion (concave) 9*h* and the second cartridge engagement portion (convex) 9*j* are formed on the cartridge opening and closing member 9*b* as shown in FIG. 4 and FIG. 23.

In this embodiment, a convex rib on the uppermost surface is the second cartridge engagement portion (convex) 9*j*, and a concave portion perpendicular to the above-mentioned convex portion 9*j* is the first cartridge engagement portion (concave) 9*h*. Note that the second cartridge engagement portion (convex) 9*j* is extended in a direction perpendicular to the axial direction of the developing sleeve 10*a*, and the first cartridge engagement portion (concave) 9*h* is extended in the axial direction of the developing sleeve 10*a*.

In the cartridge opening and closing member 9*b* an opening 9*f* for communicating the replenishing port portion 9*c* with an opening 12*f*1 of the discharge port 12*f* of the toner replenishing containers 12Y, 12M, 12C, 12K is provided. Further, a rack 9*g* which is used as a release portion is integrally formed in the cartridge opening and closing member 9*b*. The rack 9*g* receives a driving force from an opening and closing gear (large) 13*b* used as a driving member and placed in the apparatus body 100, as shown in FIG. 20.

As shown in FIG. 20, a rotary shaft 13*a* of the opening and closing gear 13*b* is placed above each of the process cartridges 9Y, 9M, 9C, 9K, in parallel to the axis of the photosensitive drum 7. The above-mentioned opening and closing gear (large) 13*b* is fixed to the end of the rotary shaft 13*a* on that side. To the end of this side of the rotary shaft 13*a* is fixed a rotary lever 13*c*. Further, the rotary shaft 13*a* is rotatably supported with a bearing (not shown) in the apparatus body 100.

When the rotary lever 13*c* is rotated, the opening and closing gear (large) 13*b* is rotated through the rotary shaft 13*a* while interlocked therewith. Then, when each of the process cartridges 9Y, 9M, 9C, 9K is inserted into the apparatus body 100 and is set at a given position, the opening and closing gear (large) 13*b* engages with the teeth of rack 9*g* at a given phase, as shown in FIG. 9. And by the rotary driving of the opening and closing gear (large) 13*b*, the rack 9*g* receives a driving force and is slid in the axial direction of guide rib 9*e* (a direction perpendicular to the axial direction of the developing sleeve 10*a*).

Figure 19:
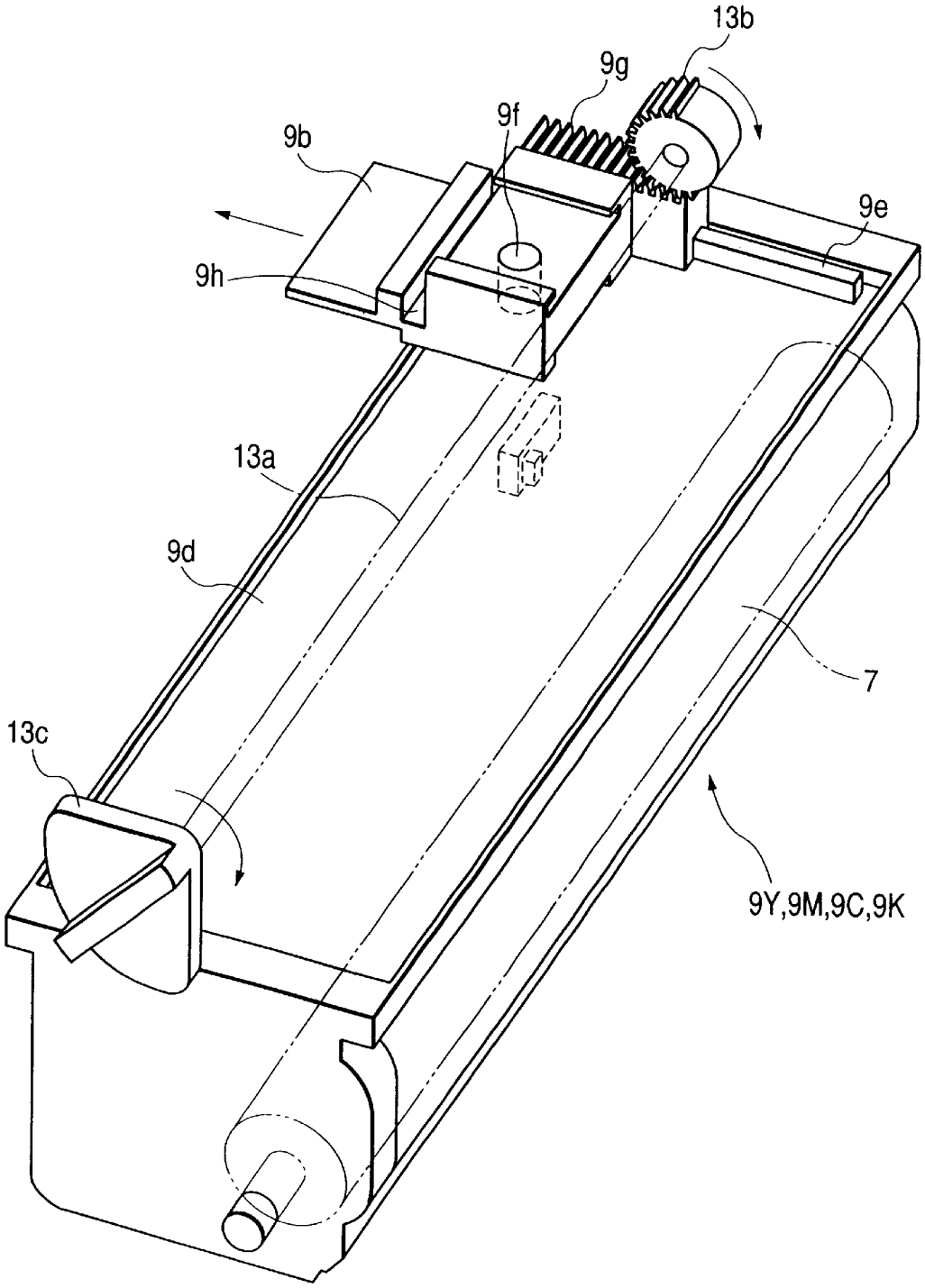
FIG. 19 is a schematic external perspective view (open state) of the process cartridge of Embodiment 1.
Figure 20:
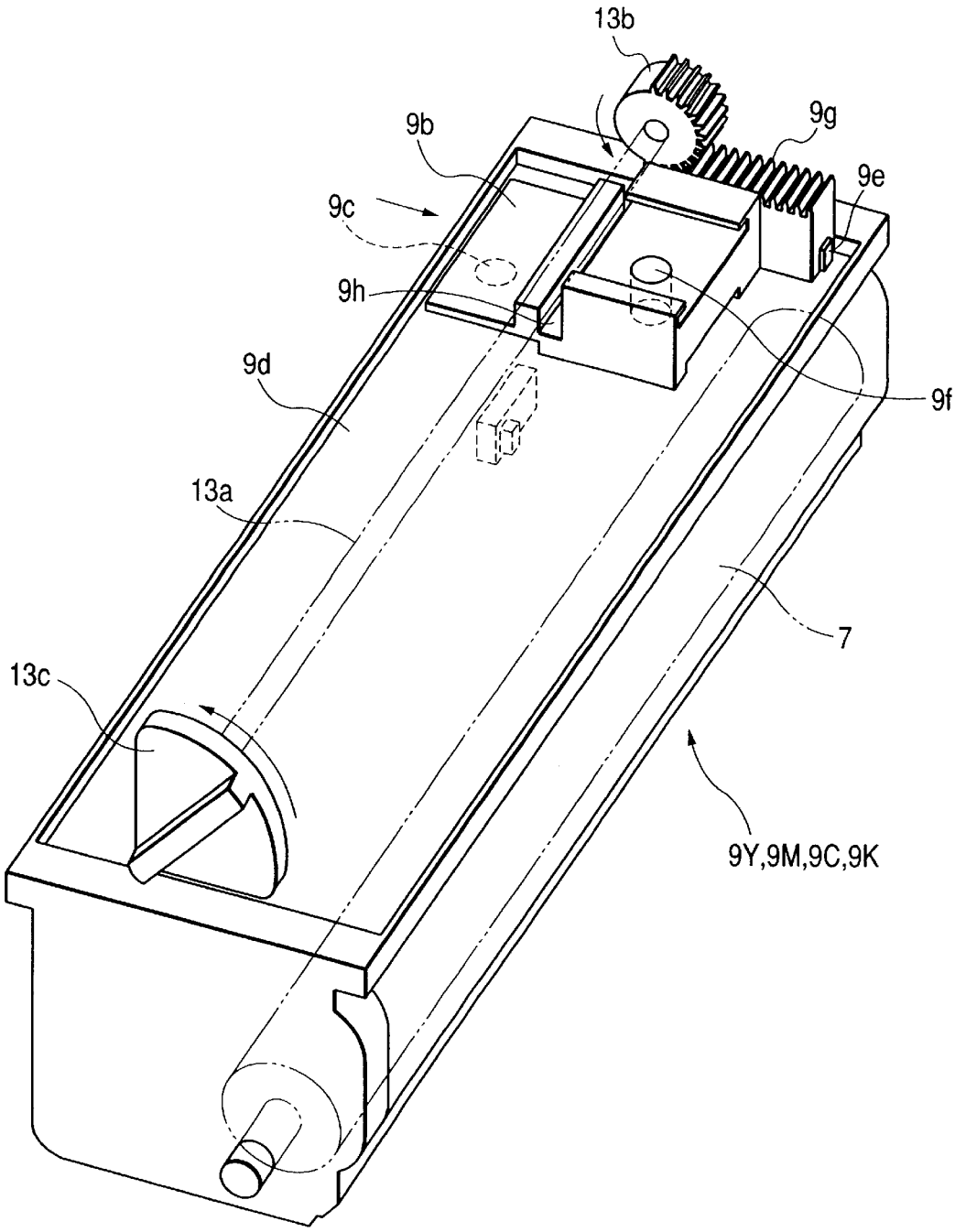
FIG. 20 is a schematic external perspective view (sealed state) of the process cartridge of Embodiment

In a state where the process cartridges 9Y, 9M, 9C, 9K are set in the apparatus body 100, when the rotary lever 13*c* is rotated clockwise, the cartridge opening and closing member 9*b* is slid leftward through the rotary shaft 13*a* and the opening and closing gear (large) 13*b* (see FIG. 19). When the rotary lever 13*c* is rotated counterclockwise under this state, the cartridge opening and closing member 9*b* is slid rightward and is returned to the original position (see FIG. 20). That is, by the rotation of the rotary lever 13*c* the cartridge opening and closing member 9*b* is slid in a direction perpendicular to the axial direction of the developing sleeve 10*a* so that it moves freely between the first position (released or opened position (see FIG. 19)) which opens the replenishing port portion 9*c* and the second position (sealed or closed position (see FIG. 20)) which closes or seals the replenishing port portion 9*c*.

Next, configurations of a discharge port of the toner replenishing container and a toner replenishing container opening and closing member will be described with reference to FIG. 3, FIG. 5, FIG. 9, FIG. 21, and FIG. 22.

Figure 5:
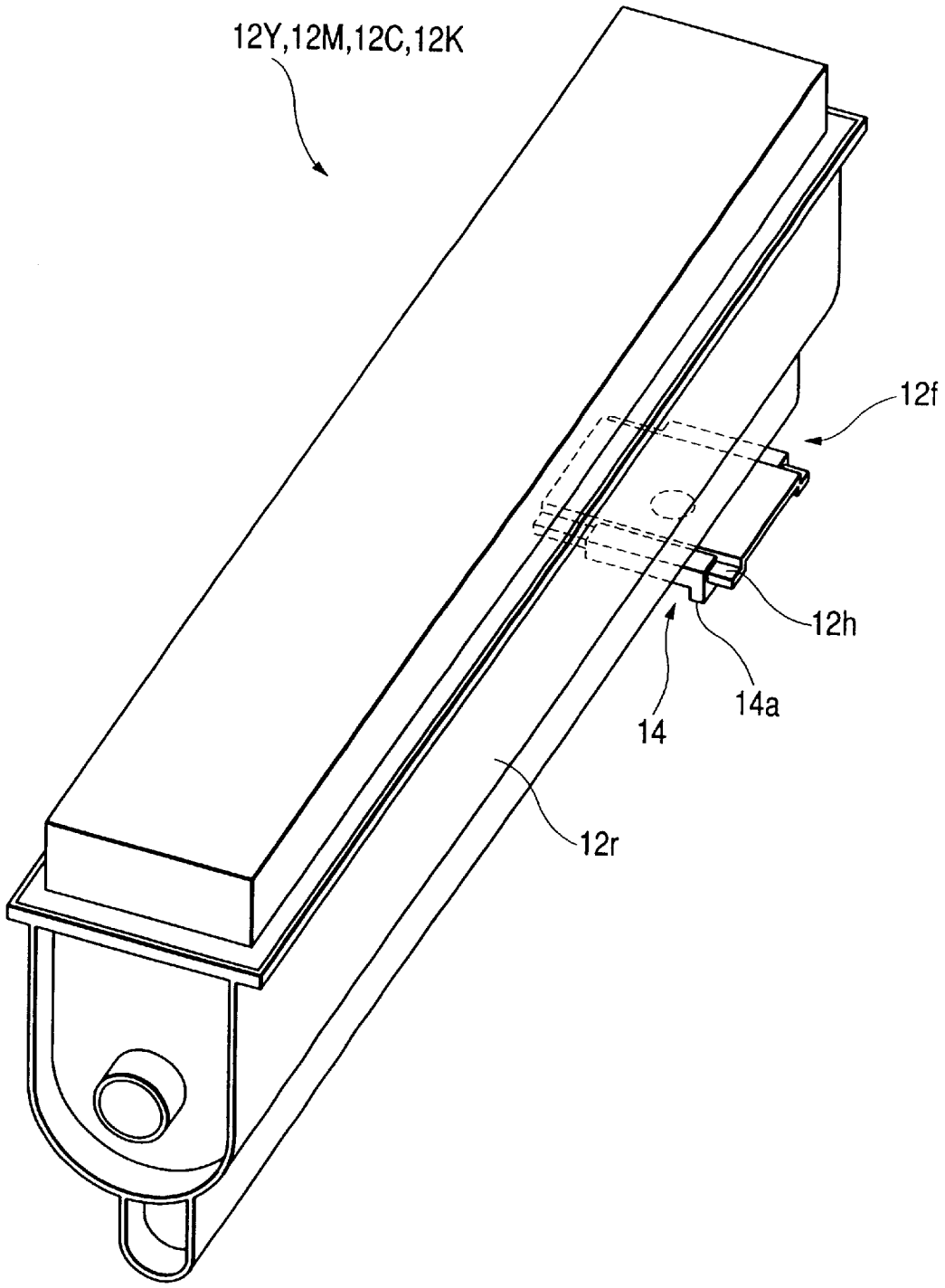
FIG. 5 is a schematic external perspective view of the toner replenishing container of Embodiment 1.

In a part of the bottom of the toner replenishing containers 12Y, 12M, 12C, 12K is provided the discharge port portion 12*f* for discharging toner outside the container, as shown in FIG. 3 and FIG. 5. At the center of the discharge port portion 12*f* is formed an opening 12*f*1 for a discharge port. A sealing member 12*g* is adhered to the bottom portion of each of the toner replenishing containers 12Y, 12M, 12C, 12K so as to surround the periphery of the opening 12*f*1. In this embodiment, the discharge port portion 12*f* is placed on that side of each of the toner replenishing containers 12Y, 12M, 12C, 12K (near the forefront in a direction of inserting the containers into the apparatus body 100) which is on the drive transmission side of the screw 12*a*.

Figure 22:
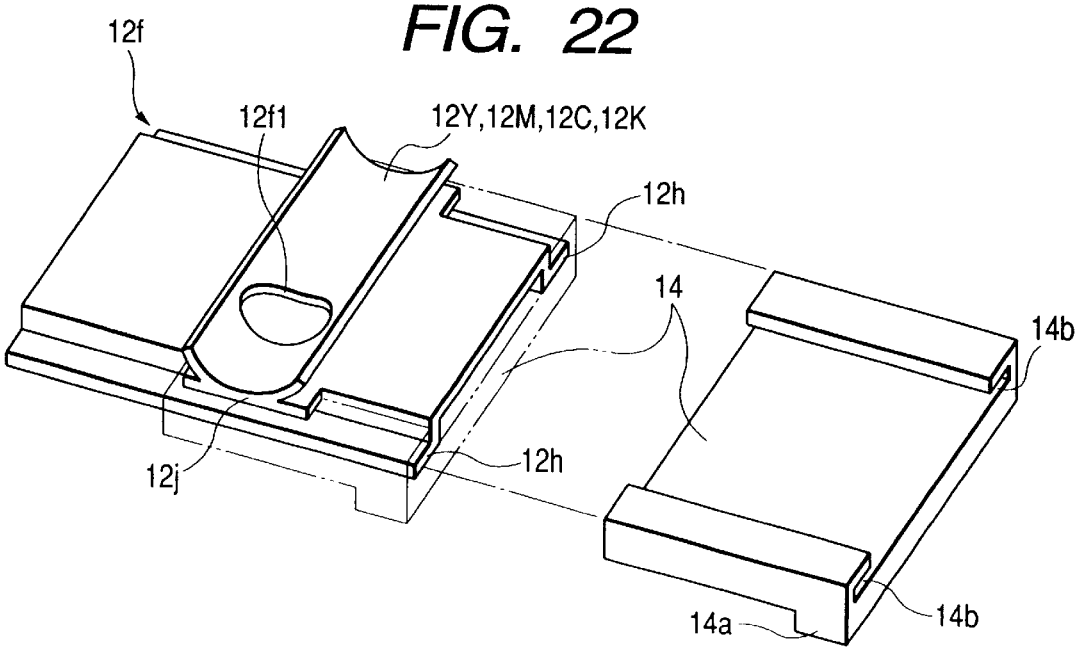
FIG. 22 is an explanatory view of a state (sealed state) before the engagement of a toner replenishing container opening and closing member, and a discharge port portion.

As shown in FIG. 3, FIG. 5, and FIG. 22, in the periphery of the discharge port portion 12*f* on the bottom of each of the toner replenishing containers 12Y, 12M, 12C, 12K are formed the first toner replenishing container engagement portion (convex) 12*h* and the second toner replenishing container engagement portion (concave) 12*j* used as a replenishing container engagement portion. The toner replenishing container engagement portions 12*h*, 12*j* form an integral rail with concave and convex portions combined, which is extended in a direction perpendicular to the axial direction of the developing sleeve 10*a*. In this embodiment, a convex rib on the lowermost surface is the first toner replenishing container engagement portion (convex) 12*h* and a concave portion just above the convex rib is the second toner replenishing container engagement portion (concave) 12*j*.

A toner replenishing container opening and closing member 14 used as a replenishing container opening and closing member engages with the discharge port portion 12*f* on the lower side of the discharge port portion 12*f*, that is, the drive input side for driving the agitating plate 12*b* (that side in a direction of inserting the toner replenishing container) so that a port 12*f*1 can be opened and closed. Thus, the toner replenishing container opening and closing member 14 can be moved between the first position (opened or released position) for opening the port 12*f*1 of the discharge port portion 12*f* and the second position (sealed or closed position) for sealing and closing the port 12*f*1.

In the toner replenishing container opening and closing member 14 are formed a first driving force receiving portion 14*a* (convex) for opening and closing the toner replenishing container and a second driving force receiving portion 14*b* (concave) for opening and closing the toner replenishing container, which are used as driving force receiving portions as shown in FIG. 5. In this embodiment, a concave rib on the uppermost surface is the second driving force receiving portion 14*b* (concave) for opening and closing the toner replenishing container, and a convex rib perpendicular to the concave rib is the first driving force receiving portion 14*a* (convex) for opening and closing the toner replenishing container. Note that the second driving force receiving portion 14*b* (concave) for opening and closing the toner replenishing container is extended in a direction perpendicular to the axial direction of the screw 12*a*, and the first driving force receiving portion 14*a* (convex) for opening and closing the toner replenishing container is extended in the axial direction of the screw 12*a* to protrude downward (on the process cartridge side).

Figure 21:
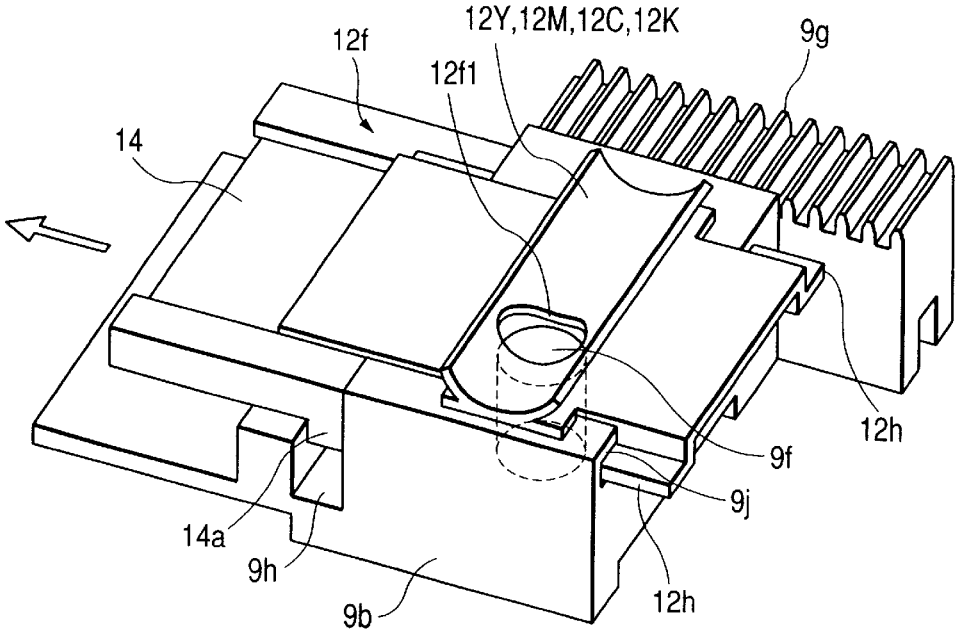
FIG. 21 is an explanatory view of an engagement state (open state) between a cartridge opening and closing member, a toner replenishing container opening and closing member, and a discharge port portion.

The toner replenishing container opening and closing member 14 is slid in a direction perpendicular to the axial direction of the screw 12*a* with respect to the discharge port portion 12*f* of the toner replenishing containers 12Y, 12M, 12C, 12K, by inserting the above-mentioned second driving force receiving portion 14*b* (concave) for opening and closing the toner replenishing container onto the first toner replenishing engagement portion (convex) 12*h* of the toner replenishing containers 12Y, 12M, 12C, 12K (see FIG. 21 and FIG. 22). Accordingly, the toner replenishing container opening and closing member 14 can be moved between the first position for opening the port 12*f*1 of the discharge port portion 12*f*1 and the second position for sealing or closing the port 12*f*1.

Next, toner replenishing from the toner replenishing container to the process cartridge will be described with reference to FIG. 6, FIG. 7, FIG. 8. FIG. 9, FIG. 21, FIG. 22, and FIG. 23.

Here, a case where the process cartridges 9Y, 9M, 9C, 9K are inserted in the apparatus body 100, and then the toner replenishing containers 12Y, 12M, 12C, 12K are inserted therein (see FIG. 8).

Figure 7:
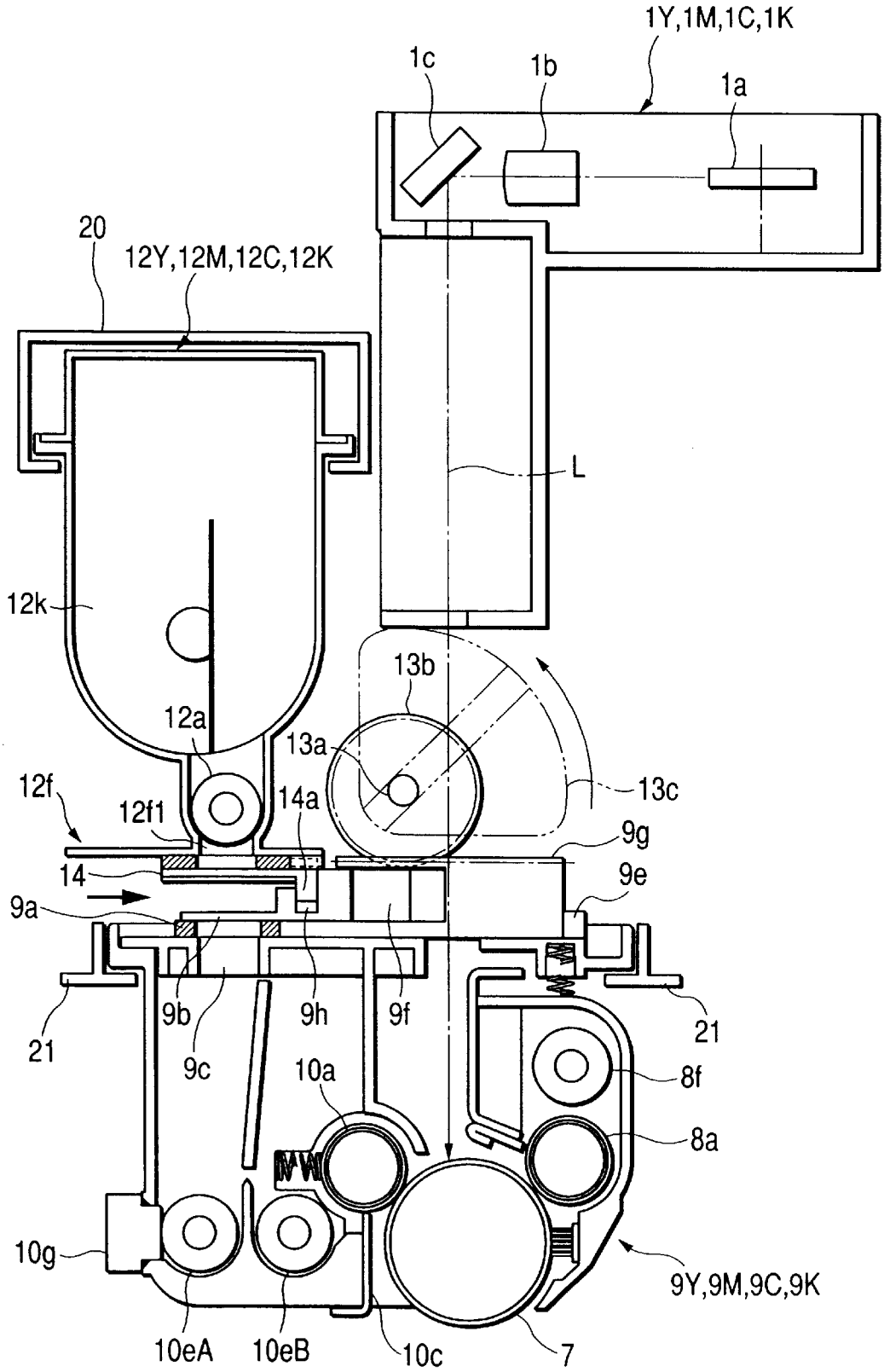
FIG. 7 is a cross-sectional view of an engagement state (sealed state) between the process cartridge and the toner replenishing container of Embodiment 1.

As shown in FIG. 7 and FIG. 23, when the toner replenishing containers 12Y, 12M, 12C, 12K are inserted into the apparatus body 100, the first driving force receiving portion 14*a* (convex) for opening and closing the toner replenishing container of the toner replenishing container opening and closing member 14 is inserted and engages with the first cartridge engagement portion (concave) 9*h* of the cartridge opening and closing member 9*b*. The engagement relationship is the same as in the case where the toner replenishing containers 12Y, 12M, 12C, 12K are first inserted into the apparatus body 100 and then the process cartridges 9Y, 9M, 9C, 9K are inserted therein.

In this engagement state, that is, the state where the process cartridges 9Y, 9M, 9C, 9K and the toner replenishing containers 12Y, 12M, 12C, 12K are inserted in the apparatus body 100, the cartridge opening and closing member 9*b* is at the second position for sealing or closing the replenishing port portion 9*c*, and the toner replenishing container opening and closing member 14 is at the second position for sealing or closing the port 12*f*1 of the discharge port portion 12*f*. And in a state where the cartridge opening and closing member 9*b* is at the second position the rack 9*g* engages with the opening and closing gear 13*b* (see FIG. 20). In this engagement state, when the rotary lever 13*c* is rotated clockwise, the cartridge opening and closing member 9*b* and the toner replenishing container opening and closing member 14 are integrally moved in the left direction (a direction perpendicular to the axial direction of the developing sleeve 10*a*) (see FIG. 6). And when the cartridge opening and closing member 9*b* and the toner replenishing container opening and closing member 14 are moved from the respective second positions to the respective first positions, the port 12*f*1 of the discharge port portion 12*f* of the toner replenishing containers 12Y, 12M, 12C, 12K and the replenishing port portion 9*c* of the process cartridges 9Y, 9M, 9C, 9K are communicated through the opening 9*f* of the cartridge opening and closing member 9*b* so that the respective toner replenishing from the toner replenishing containers 12Y, 12M, 12C, 12K to the process cartridges 9Y, 9M, 9C, 9K is made.

On the other hand, simultaneously or a short time later when the toner replenishing container opening and closing member 14 is moved, the second cartridge engagement portion (convex) 9*j* of the cartridge opening and closing member 9*b* is inserted into and engages with the second toner replenishing container engagement portion (concave) 12*j* of the discharge port portion 12*f* of each of the toner replenishing containers 12Y, 12M, 12C, 12K (see FIG. 21 and FIG. 22).

That is, by the engagement of the second cartridge engagement portion (convex) 9*j* with the second toner replenishing container engagement portion (concave) 12*j*, a position of the cartridge opening and closing member 9*b* in the height direction with respect to the discharge port portion 12*f* of the toner replenishing containers 12Y, 12M, 12C, 12K can be correctly determined. And the sealing member 12*g* placed on the toner replenishing container 12Y, 12M, 12C, 12K side closely contacts to the cartridge opening and closing member 9*b*. Accordingly, the toner leakage during replenishing can be preferably prevented.

Embodiment 2

Next, a toner replenishing structure of Embodiment 2 will be described with reference to FIG. 12, FIG. 13, FIG. 14, and FIG. 15. Note that the same components as in Embodiment 1 are denoted by the same reference numerals. Thus, components different from those in Embodiment 1 will be described.

The point in this embodiment, significantly different from Embodiment 1 is that, in contrast with Embodiment 1 where the drive transmission means such as the opening and closing gear (large) 13*b* and the opening and closing lever 13*c* for opening and closing the opening 9*f* with the cartridge opening and closing member 9*b* is placed on the apparatus body 100, in Embodiment 2 the drive transmission means is placed on the toner replenishing container 12Y, 12M, 12c, 12K.

These arrangement configurations will be described in detail.

Figure 12:
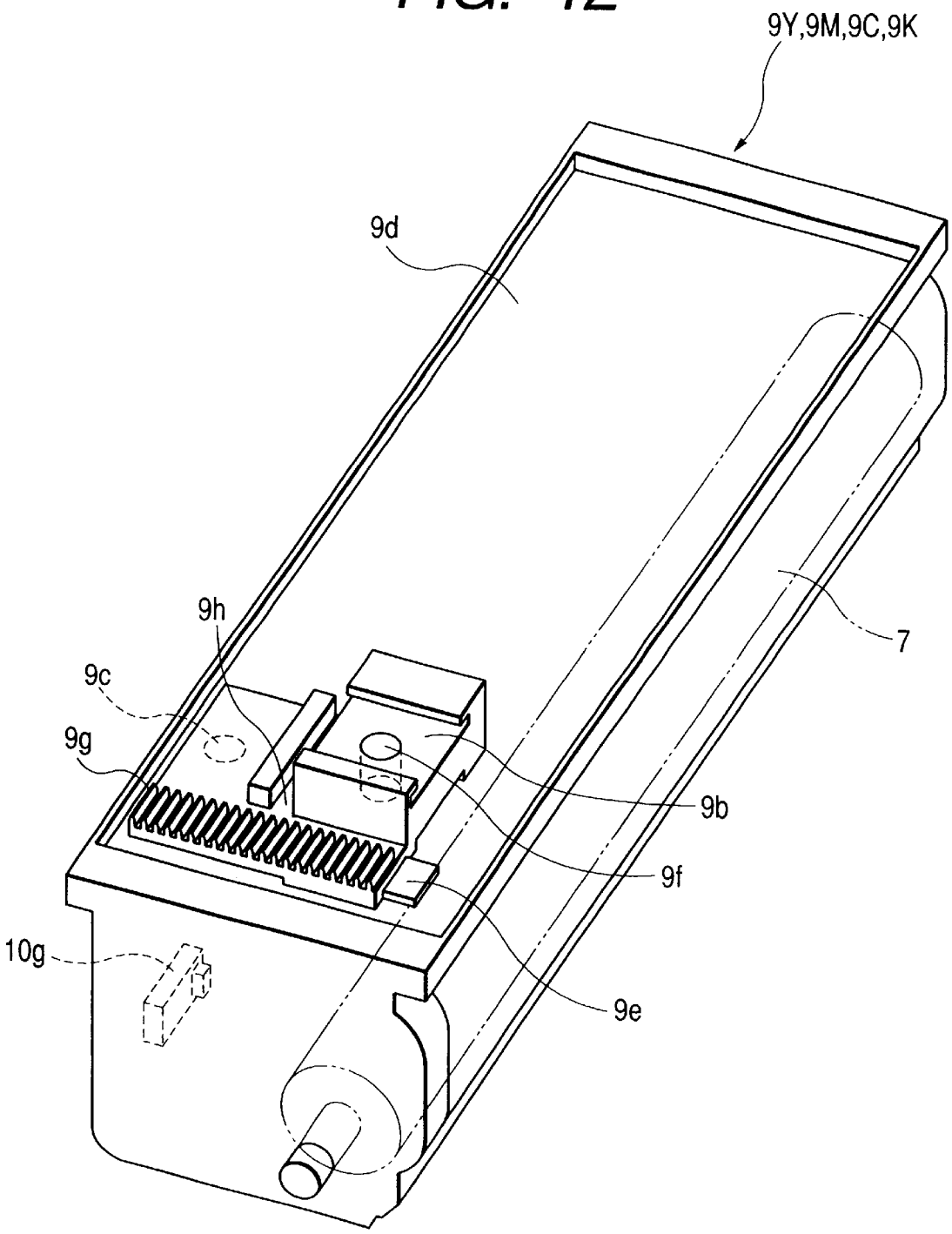
FIG. 12 is a schematic external perspective view of a process cartridge of Embodiment 2.
Figure 13:
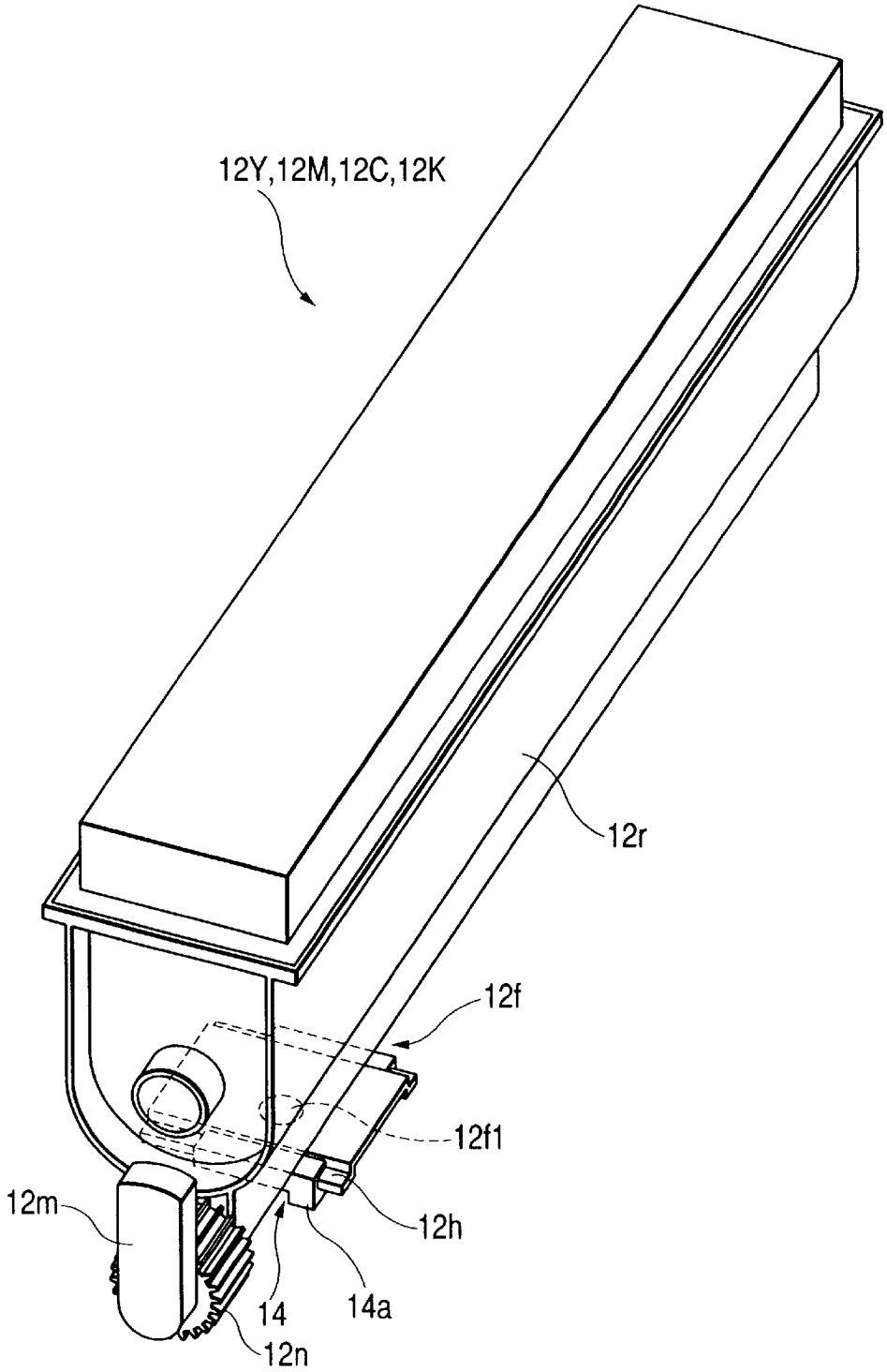
FIG. 13 is a schematic external perspective view of a toner replenishing container of Embodiment 2.

The replenishing port portion 9*c* of each of the process cartridges 9Y, 9M, 9C, 9K is placed on this side in a direction of inserting the process cartridges 9Y, 9M, 9C, 9K, which is the non-driving side of the photosensitive drum 7 (see FIG. 12). On the other hand, the discharge port portion 12*f* of each of the toner replenishing containers 12Y, 12M, 12C, 12K is placed on this side in the direction of inserting the process cartridges 9Y, 9M, 9C, 9K in correspondence to the replenishing port portion 9*c* (see FIG. 13). Further, a rotary lever 12*m* is rotatably placed on this side surface of each of the toner replenishing containers 12Y, 12M, 12C, 12K. And the rotary lever 12*m* is provided with a gear 12*n* as a driving member.

Here, a case where the toner replenishing containers 12Y, 12M, 12C, 12K are inserted in a state where the process cartridges 9Y, 9M, 9C, 9K have already been inserted in the apparatus body 100, will be described.

Figure 15:
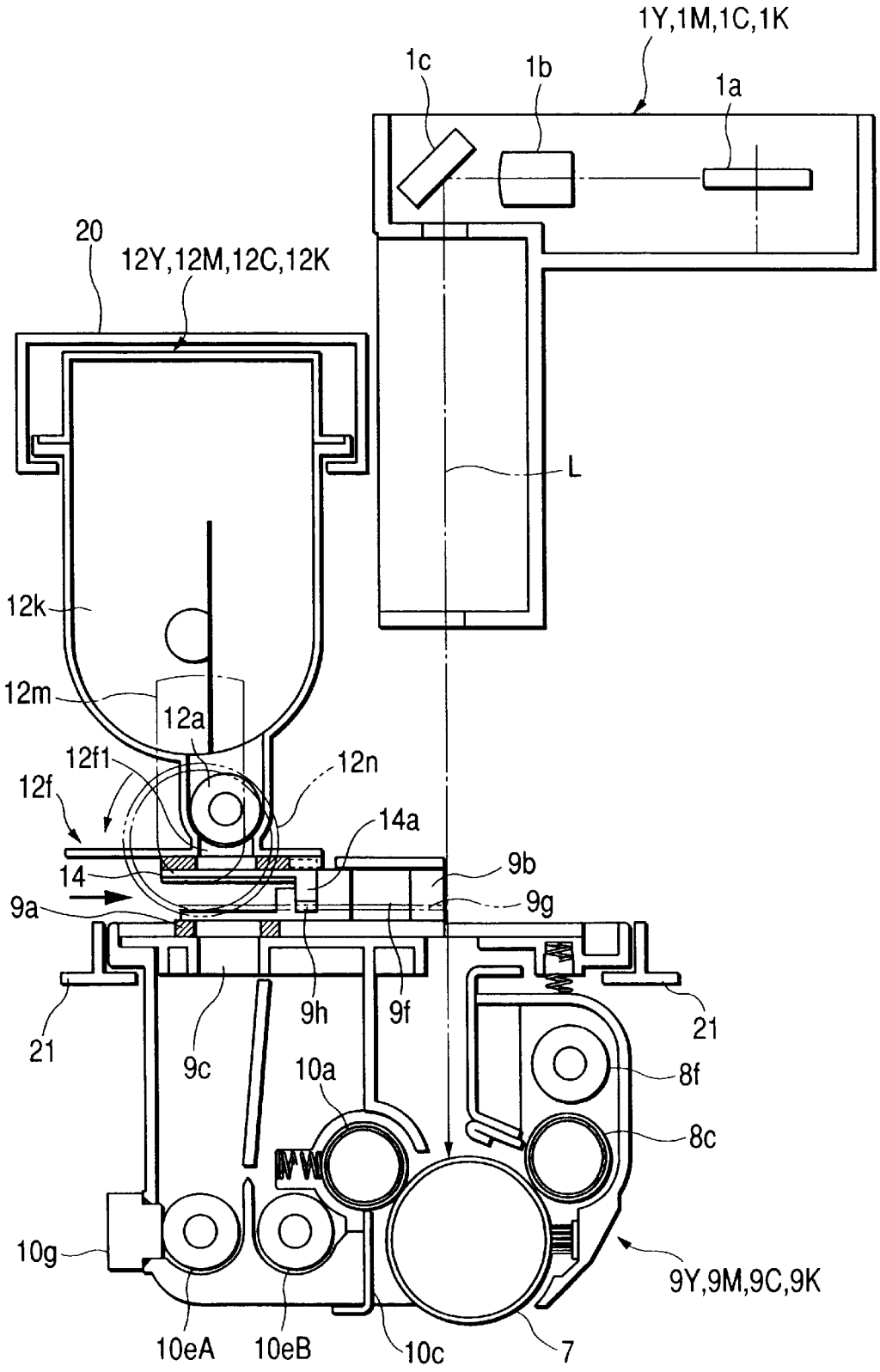
FIG. 15 is a cross-sectional view of an engagement state (sealed state) between the process cartridge and the toner replenishing container of Embodiment 2.

When the toner replenishing containers 12Y, 12M, 12C, 12K are inserted in the apparatus body 100, as shown in FIG. 15, the first driving force receiving portion 14*a* (convex) for opening and closing the toner replenishing container of the toner replenishing container opening and closing member 14 is inserted into and engages with the first cartridge engagement portion (concave) 9*h* of the cartridge opening and closing member 9*b*, that is in the second position sealing the replenishing port portion 9*c*. This engagement relationship is the same as in the case where the toner replenishing containers 12Y, 12M, 12C, 12K are first inserted in the apparatus body 100 and then the process cartridges 9Y, 9M, 9C, 9K are inserted therein. Further at this time, the gear 12*n* provided on the rotary lever 12*m* of each of the toner replenishing containers 12Y, 12M, 12C, 12K is inserted into and engages with the rack 9*g* of the cartridge opening and closing member 9*b*.

In this state, when the rotary lever 12*m* is rotated clockwise, the rotation drive of the gear 12*n* is transmitted to the cartridge opening and closing member 9*b* through the rack 9*g*.

Figure 14:
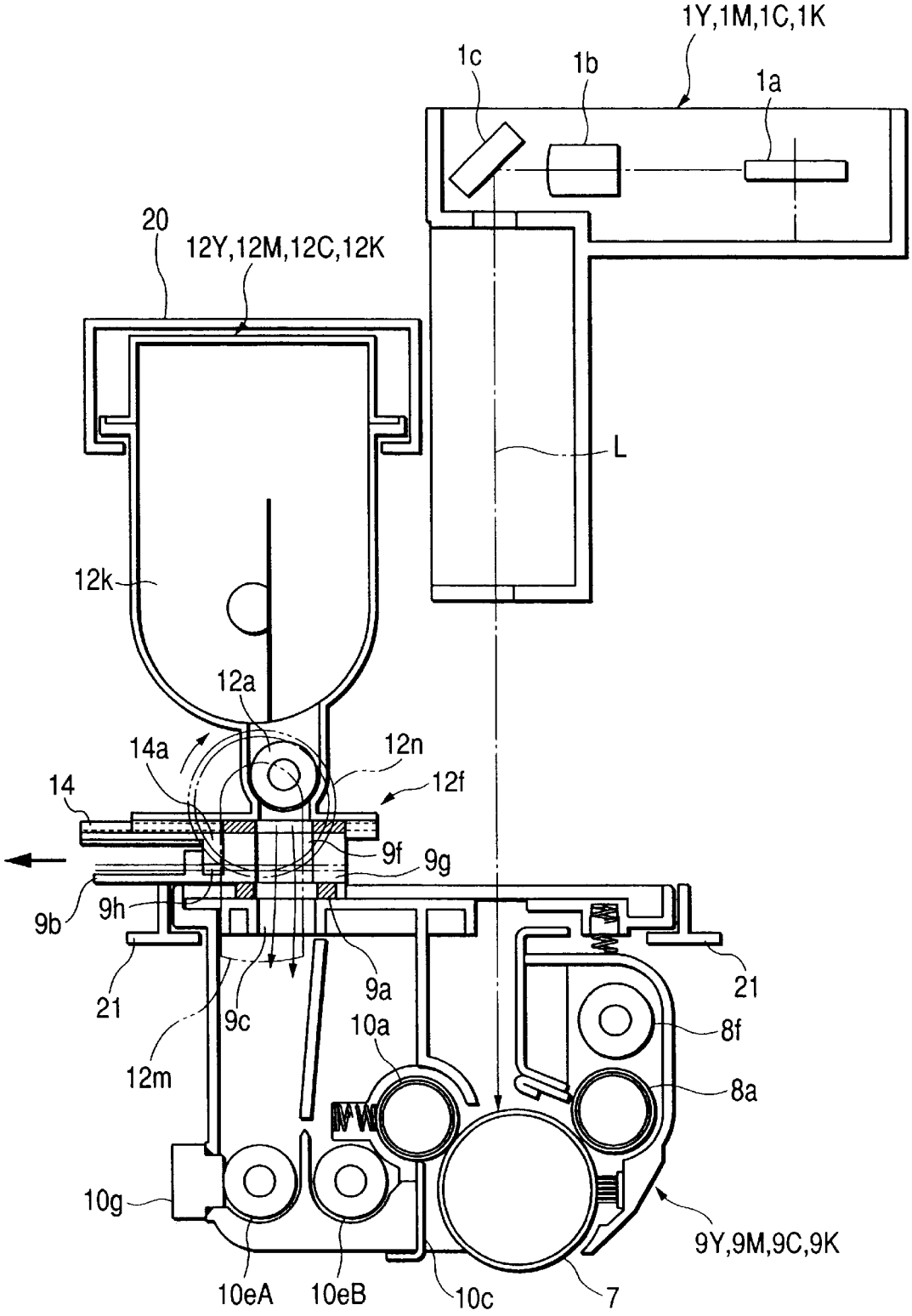
FIG. 14 is a cross-sectional view of an engagement state (open state) between the process cartridge and the toner replenishing container of Embodiment 2.

At this time, in the same manner as described in Embodiment 1, the cartridge opening and closing member 9*b* and the toner replenishing container opening and closing member 14 are integrally moved in the left direction (see FIG. 14). And when the cartridge opening and closing member 9*b* and the toner replenishing container opening and closing member 14 are moved from the respective second positions to the respective first positions, as shown in FIG. 14, the port 12*f*1 of the discharge port portion 12*f* of the toner replenishing containers 12Y, 12M, 12C, 12K and the replenishing port portion 9*c* of the process cartridges 9Y, 9M, 9C, 9K are communicated with each other through the opening 9*f* of the cartridge opening and closing member 9*b* so that the toner replenishing from the toner replenishing containers 12Y, 12M, 12C, 12K to the process cartridges 9Y, 9M, 9C, 9K is made.

Embodiment 3

Next, a toner replenishing structure of Embodiment 3 will be described with reference to FIG. 16, FIG. 17, FIG. 18, and FIG. 24. Note that the same components as in Embodiment 1 are denoted by the same reference numerals. Thus, components different from those in Embodiment 1 will be described.

The point in this embodiment, significantly different from Embodiment 1 is that, in contrast with Embodiment 1 where the drive transmission means such as the opening and closing gear (large) 13*b* and the opening and closing lever 13*c* for opening and closing the opening 9*f* with the cartridge opening and closing member 9*b* is placed on the apparatus body 100, in Embodiment 3, the drive transmission means is placed on each of the toner replenishing container 12Y, 12M, 12C, 12K. Further, points in this embodiment significantly different from Embodiment 2 are that, in contrast with Embodiment 2 where the replenishing port portion 9*c* of each of the process cartridges 9Y, 9M, 9C, 9K and the discharge port portion 12*f* of each of the toner replenishing containers 12Y, 12M, 12C, 12K are placed on this side in the direction of inserting the process cartridges 9Y, 9M, 9C and 9K, in this Embodiment, they are placed on that side in the direction of inserting the process cartridges 9Y, 9M, 9C, 9K, as in Embodiment 1.

These arrangement configurations will be described in detail.

Figure 16:
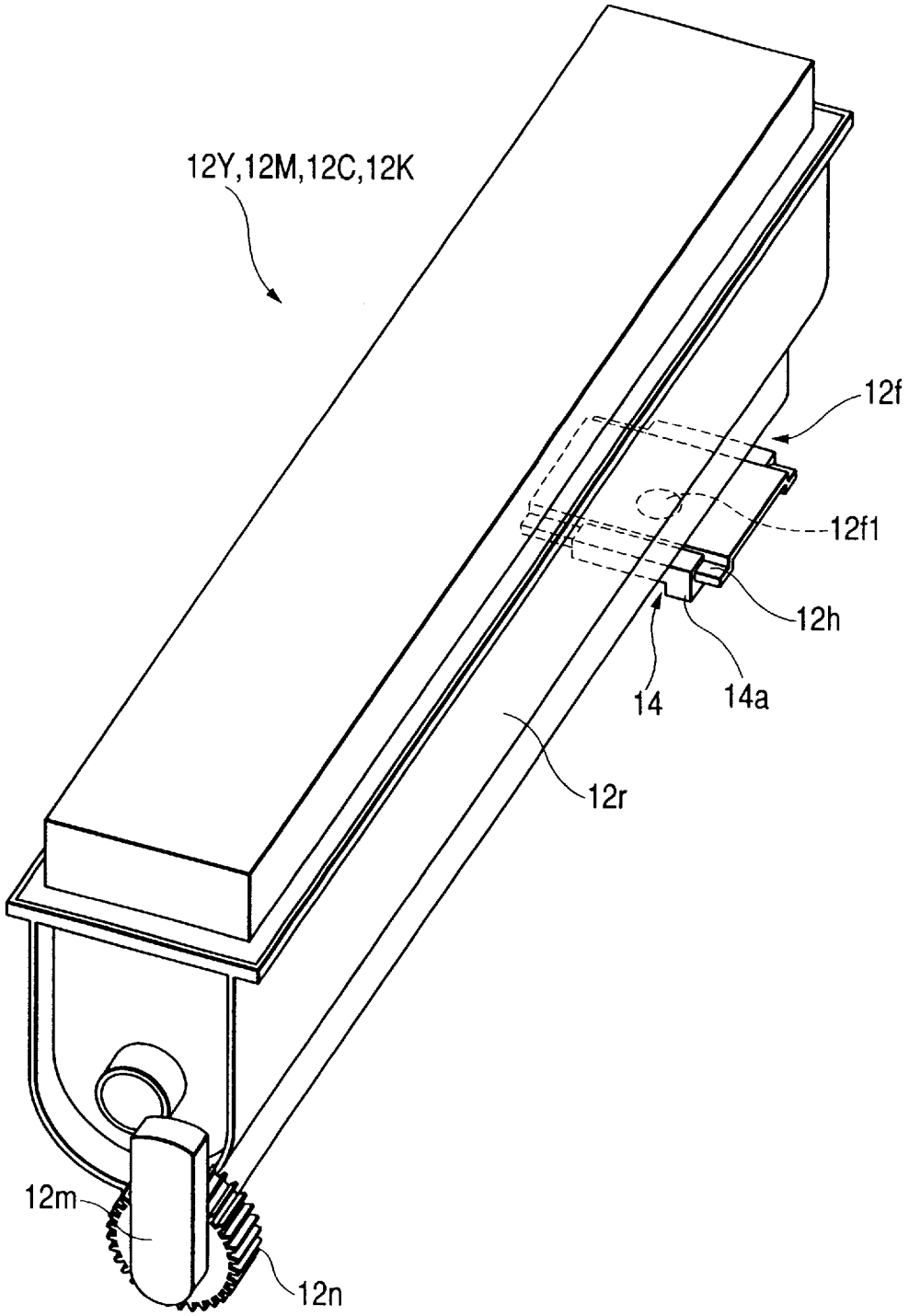
FIG. 16 is a schematic external perspective view of a toner replenishing container of Embodiment 3.
Figure 24:
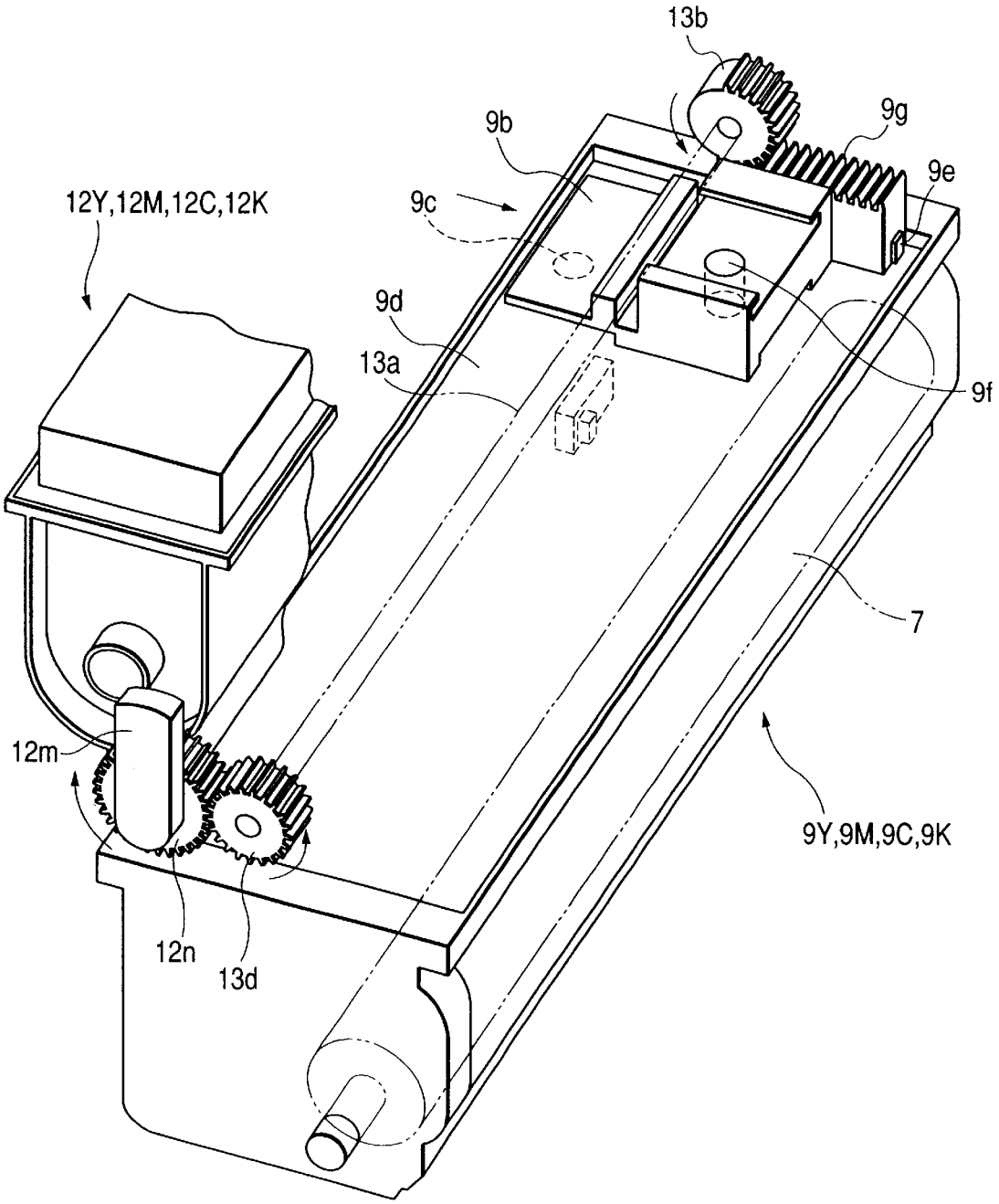
FIG. 24 is a schematic external perspective view (sealed state) of a process cartridge of Embodiment 2.

As shown in FIG. 16, the rotary lever 12*m* is rotatably placed on this side surface of each of the toner replenishing containers 12Y, 12M, 12C, 12K. And the rotary lever 12*m* is provided with a gear 12*n*. On the other hand, on the apparatus body 100, as shown in FIG. 24, the rotary shaft 13*a* is provided above each of the process cartridges 9Y, 9M, 9C and 9K, in parallel with the axis of the photosensitive drum 7, the opening and closing gear (large) 13*b* is fixed to an end of the rotary shaft 13*a* on that side, and an opening and closing gear (small) 13*d* is fixed to an end of the rotary shaft 13*a* on this side. And the rotary shaft 13*a* is rotatably supported with a bearing (not shown) with respect to the apparatus body 100.

Note that a case where the toner replenishing containers 12Y, 12M, 12C, 12K are inserted in a state where the process cartridges 9Y, 9M, 9C, 9K have already been inserted in the apparatus body 100, will be described.

Figure 18:
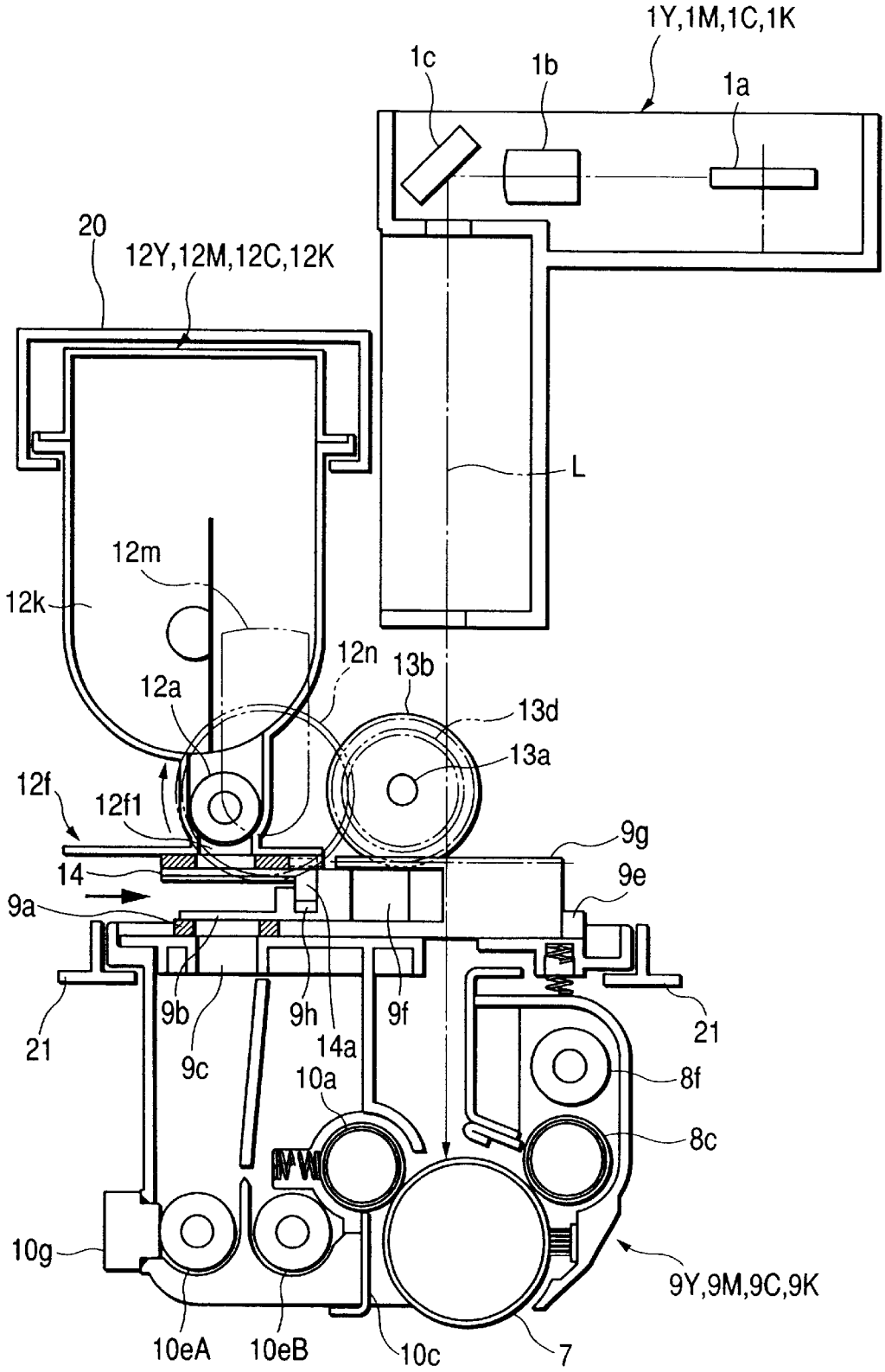
FIG. 18 is a cross-sectional view of an engagement state (sealed state) between the process cartridge and the toner replenishing container of Embodiment 3.

When the toner replenishing containers 12Y, 12M, 12C, 12K are inserted in the apparatus body 100, the first driving force receiving portion 14*a* (convex) for opening and closing the toner replenishing container of the toner replenishing container opening and closing member 14 is inserted into and engages with the first cartridge engagement portion (concave) 9*h* of the cartridge opening and closing member 9*b* that is in the second position sealing the replenishing port position 9*c* (see FIG. 18). This engagement relationship is the same as in the case where the toner replenishing containers 12Y, 12M, 12C, 12K are first inserted in the apparatus body 100 and then the process cartridges 9Y, 9M, 9C, 9K are inserted therein. Further at this time, the gear 12*n* provided on the rotary lever 12*m* of each of the toner replenishing containers 12Y, 12M, 12C, 12K is inserted into and engages with the opening and closing gear (small) 13*d* on the apparatus body 100.

In this state, when the rotary lever 12*m* is rotated counterclockwise, the rotation drive of the gear 12*n* is transmitted to the cartridge opening and closing member 9*b* through the opening and closing gear (small) 13*d*, the rotary shaft 13*a*, and the opening and closing gear (large) 13*b*.

Figure 17:
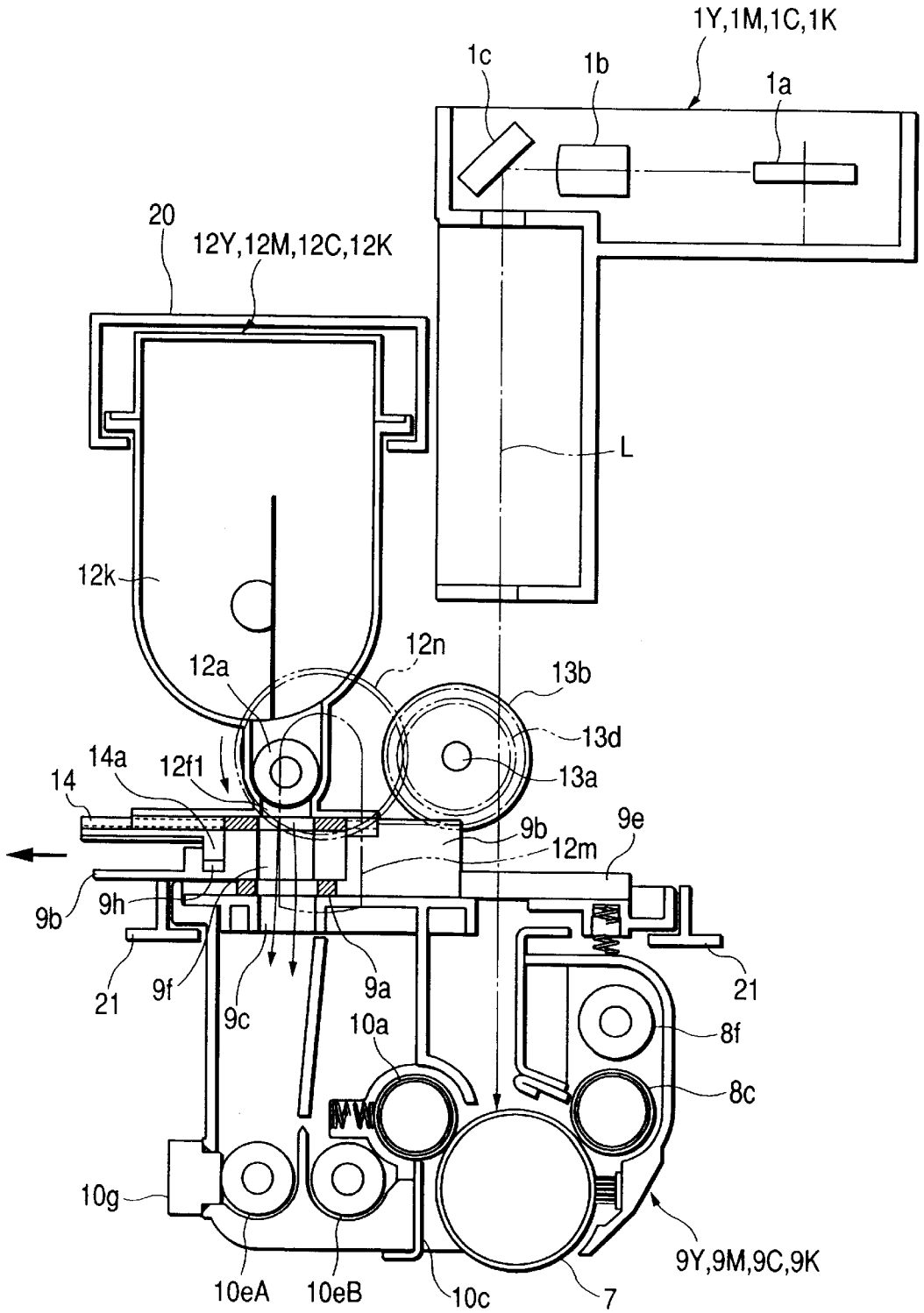
FIG. 17 is a cross-sectional view of an engagement state (open state) between a process cartridge and the toner replenishing container of Embodiment 3.

At this time, in the same manner as described in Embodiment 1, the cartridge opening and closing member 9*b* and the toner replenishing container opening and closing member 14 are integrally moved in the left direction (see FIG. 17). And when the cartridge opening and closing member 9*b* and the toner replenishing container opening and closing member 14 are moved from the respective second positions to the respective first positions, as shown in FIG. 17, the port 12*f*1 of the discharge port portion 12*f* of the toner replenishing containers 12Y, 12M, 12C, 12K and the replenishing port portion 9*c* of the process cartridges 9Y, 9M, 9C, 9K are communicated with each other through the opening 9*f* of the cartridge opening and closing member 9*b* so that the toner replenishing from the toner replenishing containers 12Y, 12M, 12C, 12K to the process cartridges 9Y, 9M, 9C, 9K is made.

Embodiment 4

Next, a toner replenishing structure of Embodiment 4 will be described with reference to FIG. 25, FIG. 26, and FIG. 27. Note that the same components as in Embodiment 1 are denoted by the same reference numerals. Thus, components different from those in Embodiment 1 will be described.

The point in this embodiment significantly different from Embodiment 1 is that, in contrast with Embodiment 1 where the rack 9*g* is formed on the cartridge opening and closing member 9*b* and the rack 9*g* is moved by engagement with the opening and closing gear (large) 13*b* of the apparatus body 100. In this embodiment, each of opening and closing slide members 13*e* (see FIG. 26) of the apparatus body 100 engages with the cartridge opening and closing member 9*b* and the cartridge opening and closing member 9*b* is moved by sliding of the opening and closing slide member 13*e*.

These arrangement configurations will be described in detail.

Figure 26:
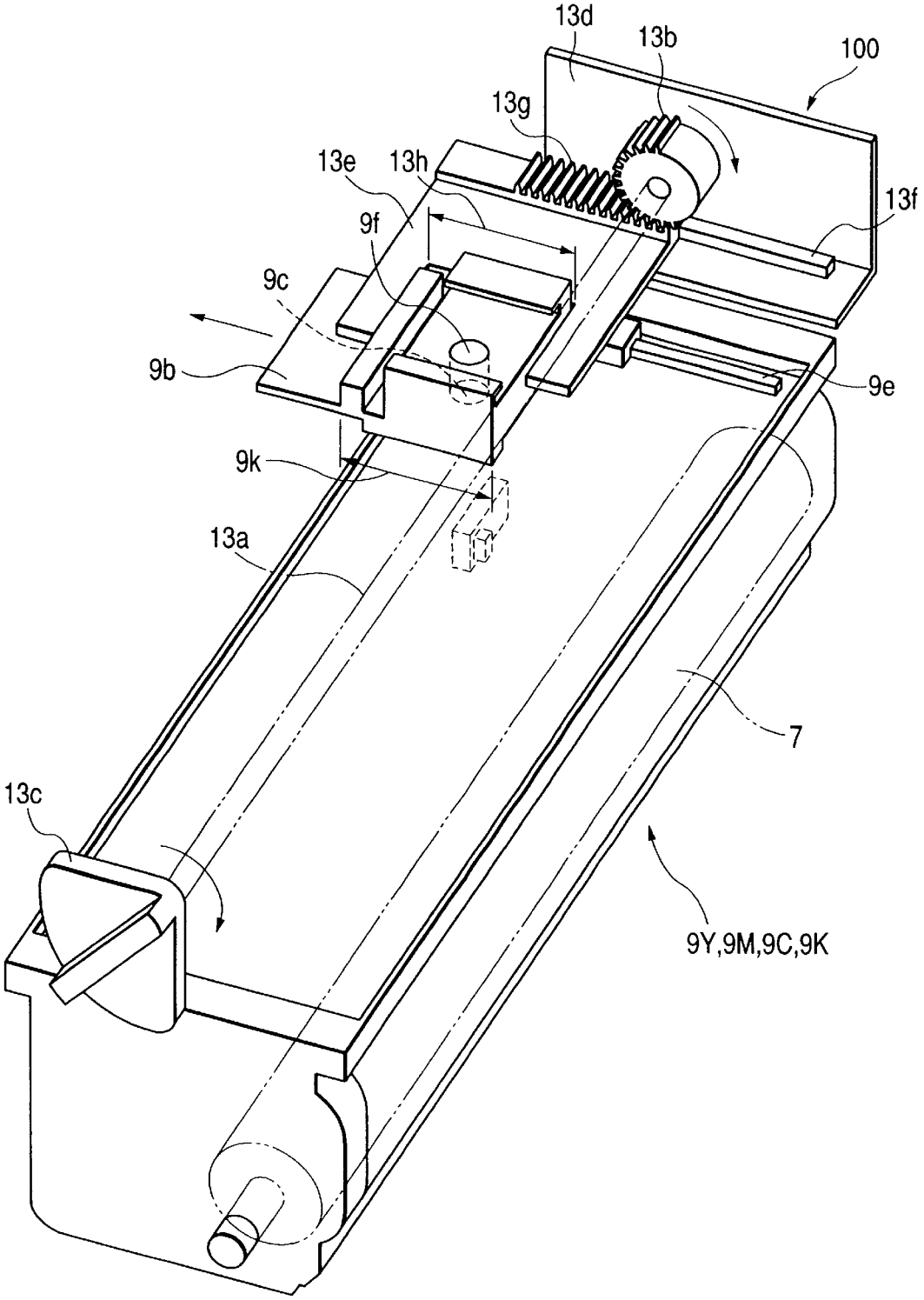
FIG. 26 is a schematic external perspective view (open state) of the process cartridge of Embodiment 4.

As shown in FIG. 26, the rotary shaft 13*a* is provided above each of the process cartridges 9Y, 9M, 9C and 9K, in parallel with the axis of the photosensitive drum 7, the opening and closing gear (large) 13*b* is fixed to an end of the rotary shaft 13*a* on that side, and the rotary lever 13*c* is fixed to an end of the rotary shaft 13*a* on this side. And the rotary shaft 13*a* is rotatably supported with a bearing (not shown) with respect to the apparatus body 100.

On that side of the apparatus body 100 are placed the frames 13*d*. On the frame 13*d* is placed the opening and closing slide member 13*e* which are horizontally moved in a direction perpendicular to the axial direction of the developing sleeve 10*a* of each of the process cartridges 9Y, 9M, 9C and 9K. The opening and closing slide member 13*e* is moved along a guide rib 13*f* formed on the frame 13*d*.

A rack 13*g* is formed on the upper surface of the opening and closing slide member 13*e* and engages with the opening and closing gear (large) 13*b*. Further, on this side of the opening and closing slide members 13*e* is formed a concave opening and closing groove 13*h*.

Figure 25:
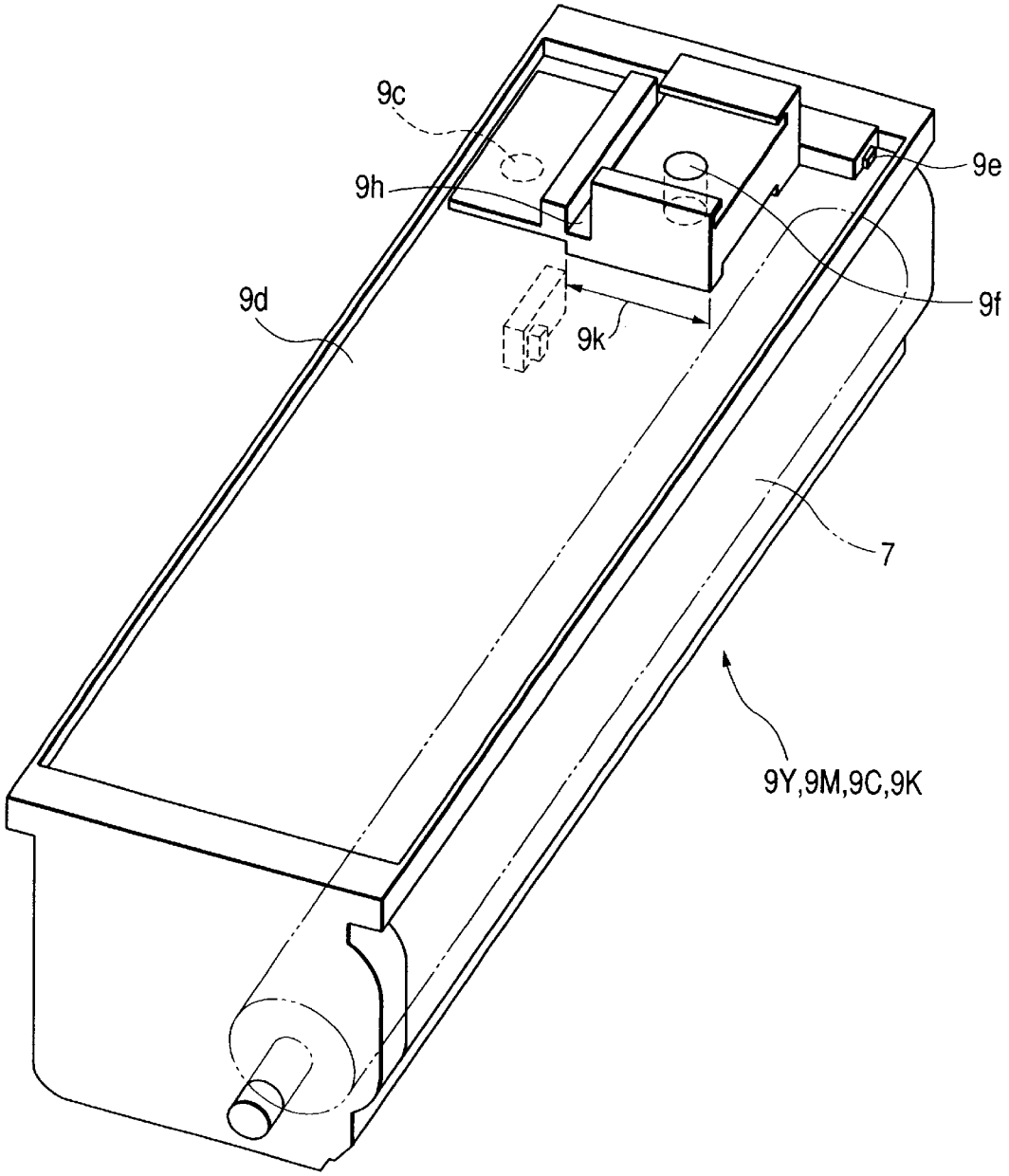
FIG. 25 is a schematic external perspective view of a process cartridge of Embodiment 4.

On the other hand, on the cartridge opening and closing member 9*b* of each of the process cartridges 9Y, 9M, 9C and 9K, as shown in FIG. 25 and FIG. 26, is provided a third cartridge engagement portion (convex) 9*k* which engages with the above-mentioned opening and closing groove 13*h*.

Figure 27:
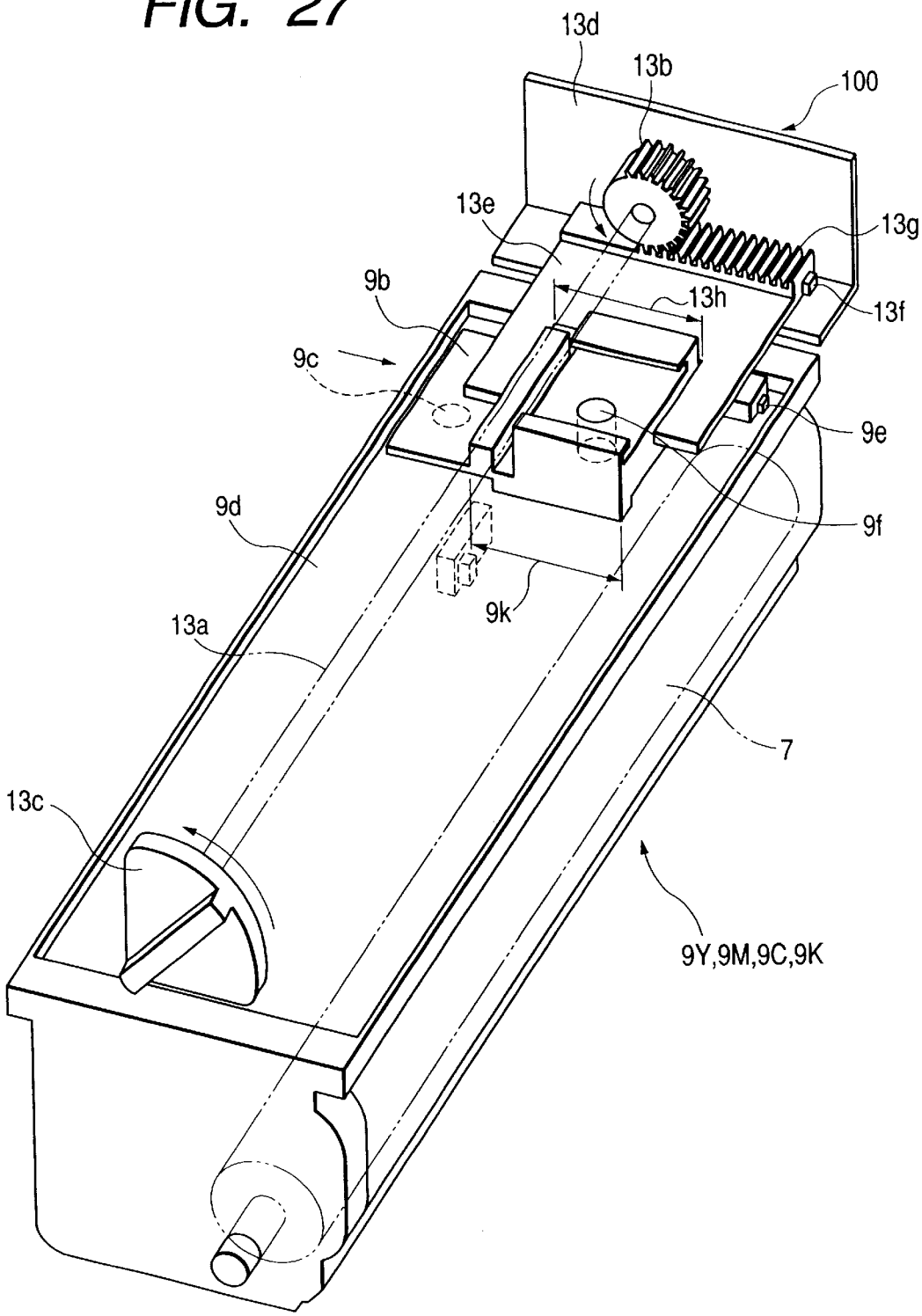
FIG. 27 is a schematic external perspective view (sealed state) of the process cartridge of Embodiment 4.

When the process cartridges 9Y, 9M, 9C, 9K are inserted into the apparatus body 100, as shown in FIG. 27, the third cartridge engagement portion (convex) 9*k* of the cartridge opening and closing member 9*b* that is at the second position where the replenishing portion 9*c* is sealed or closed engages with the opening and closing groove 13*h* of the opening and closing slide member 13*e* so that the third cartridge engagement portion (convex) 9*k* and the opening and closing slide member 13*e* can be integrally moved.

When the toner replenishing containers 12Y, 12M, 12C, 12K are inserted in the apparatus body 100, as mentioned above, the first driving force receiving portion 14*a* (convex) for opening and closing the toner replenishing container of the toner replenishing container opening and closing member 14 is inserted into and engages with the cartridge engagement portion (concave) 9*h* of the cartridge opening and closing member 9*b*. This engagement relationship is the same as in the case where the toner replenishing containers 12Y, 12M, 12C, 12K are first inserted in the apparatus body 100 and then the process cartridges 9Y, 9M, 9C, 9K are inserted therein.

Then, when the rotary lever 13*c* is rotated clockwise, the opening and closing gear (large) 13*b* is rotated through the rotary shaft 13*a*, the opening and closing slide member 13*e* is moved in a direction perpendicular to the axial direction of the developing sleeve 10*a*, and at the same time the cartridge opening and closing member 9*b* and the toner replenishing container opening and closing member 14 are moved in the same direction (see FIG. 26). And when the cartridge opening and closing member 9*b* and the toner replenishing container opening and closing member 14 are moved from the respective second positions to the respective first positions, the port 12*f*1 of the discharge port portion 12*f* of the toner replenishing containers 12Y, 12M, 12C, 12K and the replenishing port portion 9*c* of the process cartridges 9Y, 9M, 9C, 9K are communicated with each other through the opening 9*f* of the cartridge opening and closing member 9*b* so that the toner replenishing from the toner replenishing containers 12Y, 12M, 12C, 12K to the process cartridges 9Y, 9M, 9C, 9K is made.

Embodiment 5

Next, a toner replenishing structure of Embodiment 5 will be described with reference with FIG. 28 and FIG. 29. Note that the same components as in Embodiment 4 are denoted by the same reference numerals. Thus, components different from those in Embodiment 4 will be described.

The point in this embodiment significantly different from Embodiment 4 is that, in contrast with Embodiment 4 where the opening and closing slide members 13*e* are independently arranged at four positions, Embodiment 5 has a single opening and closing slide member (see FIG. 29), and by interlocking with the movement of the opening and closing slide members 13*e* the cartridge opening and closing members 9*b* at four positions can be simultaneously opened or closed.

Figure 29:
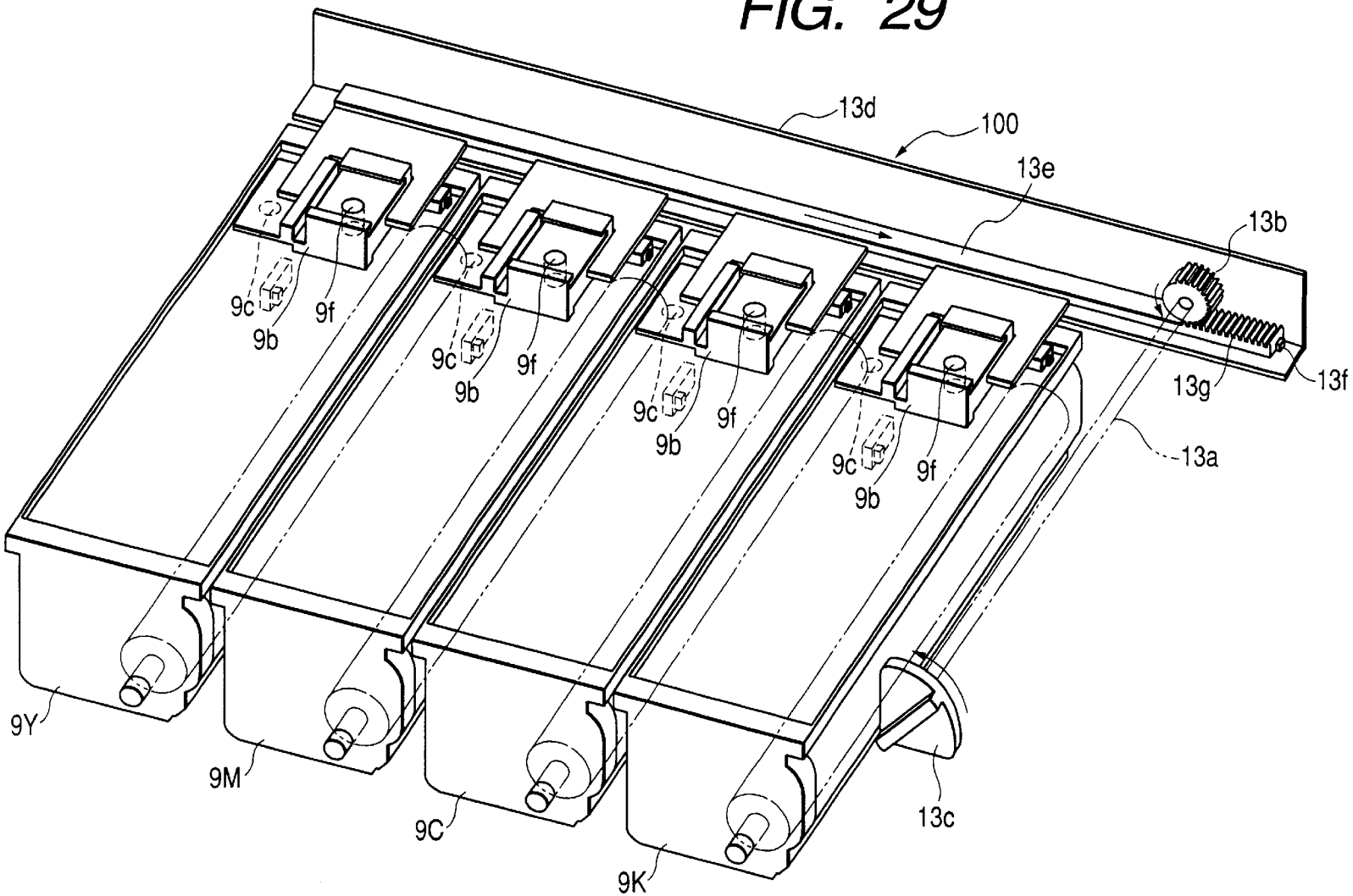
FIG. 29 is a schematic external perspective view (sealed state) of the process cartridge of Embodiment 5.

That is, when the process cartridges 9Y, 9M, 9C, 9K are inserted into the apparatus body 100, as shown in FIG. 29, the third cartridge engagement portion (convex) 9*k* of each cartridge opening and closing member 9*b* that is at the second position where the replenishing port portion 9*c* of the process cartridge 9Y, 9M, 9C, 9K is sealed or closed engages with the opening and closing groove 13*h* of the opening and closing.slide member 13*e* so that the third cartridge engagement portions (convex) 9*h* and the opening and closing slide member 13*e* can be integrally moved.

And when the toner replenishing containers 12Y, 12M, 12C, 12K are inserted in the apparatus body 100, as mentioned above, the first driving force receiving portion 14*a* (convex) for opening and closing the toner replenishing container of the toner replenishing container opening and closing member 14 is inserted into and engages with the first cartridge engagement portion (concave) 9*h* of each of the cartridge opening and closing members 9*b*. This engagement relationship is the same as in the case where the toner replenishing containers 12Y, 12M, 12C, 12K are first inserted in the apparatus body 100 and then the process cartridges 9Y, 9M, 9C, 9K are inserted therein.

Figure 28:
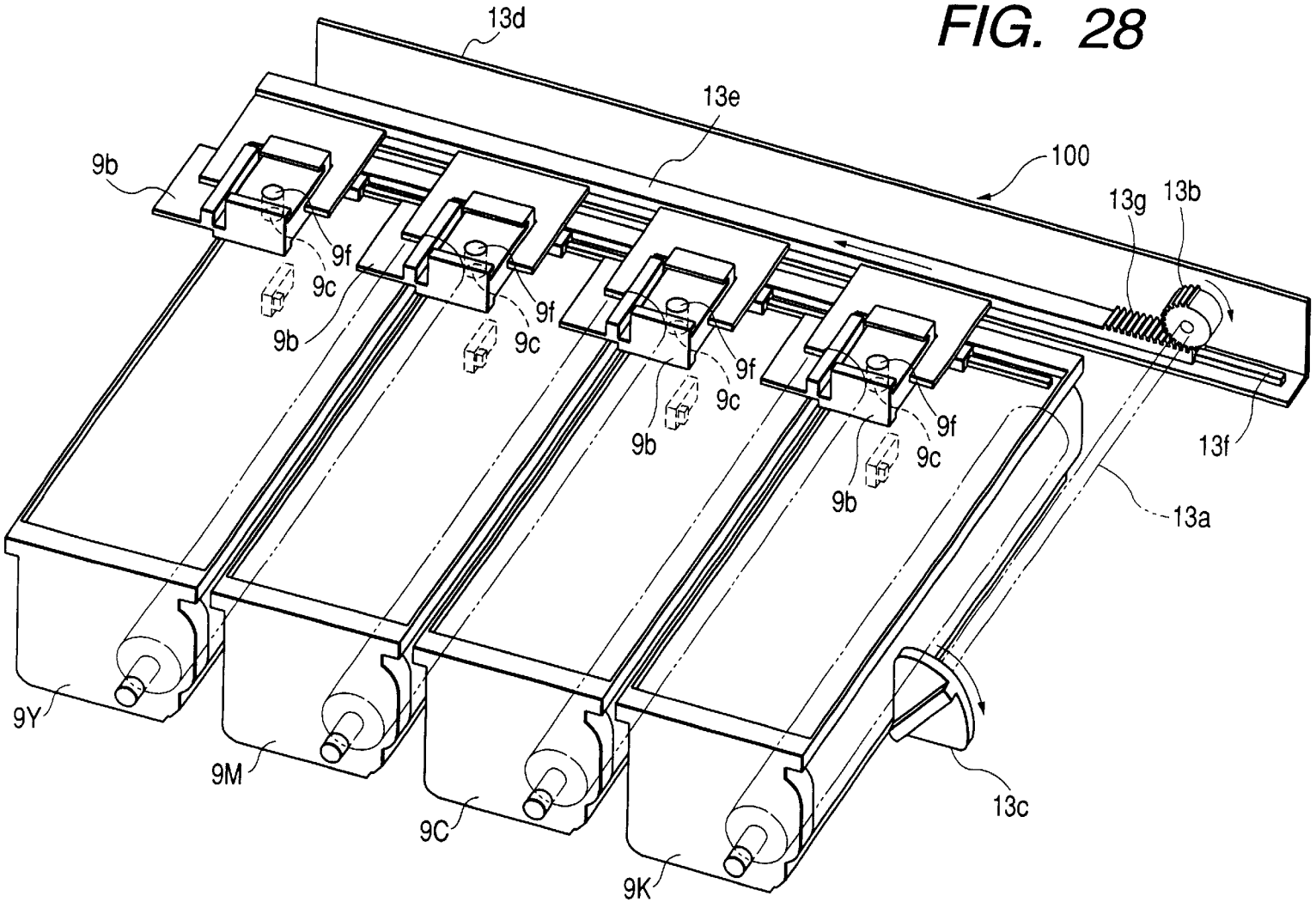
FIG. 28 is a schematic external perspective view (open state) of a process cartridge of Embodiment 5.

Then, when the rotary lever 13*c* is rotated clockwise, the opening and closing gear (large) 13*b* is rotated through the rotary shaft 13*a*, the opening and closing slide member 13*e* is moved in a direction perpendicular to the axial direction of the developing sleeve 10*a*, and at the same time all the cartridge opening and closing members 9*b* and all the toner replenishing container opening and closing members 14 are moved in the same direction (see FIG. 28). And when all the cartridge opening and closing members 9*b* and all the toner replenishing container opening and closing members 14 are moved from the respective second positions to the respective first positions, the port 12*f*1 of the discharge port portion 12*f* of each of the toner replenishing containers 12Y, 12M, 12C, 12K and the replenishing port portion 9*c* of each of the process cartridges 9Y, 9M, 9C, 9*h* are communicated with each other through the opening 9*f* of each of the cartridge opening and closing members 9*b* so that the toner replenishing from the toner replenishing containers 12Y, 12M, 12C, 12K to the process cartridges 9Y, 9M, 9C, 9*h* is made.

Other Embodiments

The toner replenishing containers shown Embodiments 1 to 5 are not limited to the replenishment to a process cartridge or a developing cartridge using the two-component development, but may also be used in the replenishiment to a process cartridge or a developing cartridge using mono-component development. Further, powder contained in a toner replenishing container may include not only toner but also a mixture of toner and magnetic carrier, a so called developer.

Further, although a color toner electrophotographic image forming apparatus that uses two-component developer is described as an example in the above Embodiments, the present invention can be preferably applied to a color toner electrophotographic image forming apparatus using a mono-component developer and a monochromatic electrophotographic image forming apparatus and the same effects can be also obtained.

Further, an electrophotographic photosensitive member (photoconductor) includes not only the photosensitive drum but also, for example, the following members. First, as the photosensitive member, photoconductor is used. The photoconductor includes, for example, amorphous silicon, amorphous selenium, zinc oxide, titanium oxide, organic photoconductor (OPC) and the like. Further, as a shape on which the photosensitive member is mounted, for example, a drum shape or a belt shape is used. In a drum-type photosensitive member, a photoconductor vapor-deposited or coated cylinder of aluminum alloy or the like can be used.

Incidentally the above-described process cartridge is defined as a member including, for example, an electrophotographic photosensitive member and at least one of process means. Therefore, the configuration of the process cartridge includes other than the ones in the Embodiments above, a cartridge integrally composed of an electrophotographic photosensitive member, developing means and charging means which is detachably mountable to the apparatus body, a cartridge integrally composed of an electrophotographic photosensitive member and developing means which is detachably mountable to the apparatus body, a cartridge integrally composed of an electrophotographic photosensitive member and cleaning means which is detachably mountable to the apparatus body, and further, a cartridge integrally combined an electrophotographic photosensitive member with two or more of the process means which is detachably mountable to the apparatus body.

That is, the above-described process cartridge is a cartridge integrally composed of the charging means, developing means or cleaning means and electrophotographic photosensitive member which is detachably mountable to the image forming apparatus body. The process cartridge is a cartridge integrally composed of at least one of the charging means, developing means and the cleaning means, and the electrophotographic photosensitive member which is detachably mountable to the image forming apparatus body, or a cartridge integrally composed of at least the developing means and electrophotographic photosensitive member which is detachably mountable to the image forming apparatus body. And a user himself can attach and detach this process cartridge from the apparatus body. Accordingly a user can perform maintenance by himself.

Further, in the above-described Embodiments, as an electrophotographic image informing apparatus a color laser beam printer is described. However, the present invention is not limited to this. Thus the present invention can be applied to another electrophotographic image forming apparatus such as an electrophotographic copier, a facsimile device or a word processor.

As described above, in an electrophotographic image forming apparatus of the present invention, a developer replenishing container containing a developer, and a cartridge connectable to the developer replenishing container can be independently mounted to the electrophotographic image forming apparatus body. And in a state where the developer replenishing container and the cartridge are mounted to the electrophotographic image forming apparatus body, the developer can be replenished from the developer replenishing container to the cartridge.

While the present invention has been described with reference to the structures disclosed herein, it is not confined to the details set forth and this application is intended to cover such modifications or changes as may come within the purposes of the improvements or the scope of the following claims.

What is claimed is:

1. An electrophotographic image forming apparatus for forming an image on a recording medium comprising:

container mounting means for detachably mounting a developer replenishing container having a developer containing portion for containing a developer and a discharge port for discharging the developer contained in said developer containing portion, said discharge port being openably sealed by a replenishing container opening and closing member;

cartridge mounting means for detachably mounting a cartridge having developing means for developing an electrostatic latent image formed on an electrophotographic photosensitive member using the developer, a developer containing portion for containing the developer to be used in developing with said developing means, and a developer receiving port for receiving the developer from said developer replenishing container into said developer containing portion, said developer receiving port being sealed by a cartridge opening and closing member; and a lever, wherein when said lever is operated in a state where said developer replenishing container and said cartridge are mounted in a main body of the electrophotographic image forming apparatus, said replenishing container opening and closing member and said cartridge opening and closing member are interlocked and moved from respective sealed positions to respective opened positions with an operation of said lever so that said discharge port of said developer replenishing container and said developer receiving port of said cartridge are communicatively connected to each other.

2. An electrophotographic image forming apparatus according to claim 1, wherein said developer replenishing container is independently, attachably and detachably positioned in said container mounting means, and said cartridge is independently, attachably and detachably positioned in said cartridge mounting means.

3. An electrophotographic image formning apparatus according to claim 1, wherein a cartridge engagement portion for engaging with said replenishing container opening and closing member and an opening portion for opening said discharge port of said developer replenishing container are provided in said cartridge, wherein said replenishing container opening and closing member is engaged with said cartridge engagement portion to be moved from a sealed position of said discharge port to an opened position in interlocking relationship with a movement of said opening portion.

4. An electrophotographic image forming apparatus according to claim 3, wherein said cartridge opening and closing member is moved from a sealed position of said developer receiving port to an opened position in interlocking relationship with a movement of said opening portion.

5. An electrophotographic image forming apparatus according to claim 3, wherein when said replenishing container opening and closing member is at the sealed position of said discharge port, said developer replenishing container is detachably mountable to the main body of said electrophotographic image forming apparatus.

6. An electrophotographic image forming apparatus according to claim 3, wherein said developer replenishing container has a rotary member for feeding a developer, said developer replenishing container being attachable to and detachable from the main body of said electrophotographic image forming apparatus in a direction parallel to an axial direction of said rotary member, wherein a movement direction of said replenishing container opening and closing member is a direction perpendicular to the direction along which said developer replenishing container is attachable to and detachable from the main body of said electrophotographic image forming apparatus.

7. An electrophotographic image forming apparatus according to claim 3, wherein a developer bearing member is disposed in the developing means of said cartridge, said cartridge being attachable to and detachable from the main body of said electrophotographic image forming apparatus in a direction parallel to an axial direction of said developer bearing member, wherein a movement direction of the cartridge engagement portion of said cartridge is a direction perpendicular to the direction along which said cartridge is attachable to and detachable from the main body of said electrophotographic image forming apparatus.

8. An electrophotographic image forming apparatus according to claim 3 or claim 4, wherein movement directions of said replenishing container opening and closing member of said developer replenishing container and the cartridge opening and closing member of said cartridge are the same.

9. An electrophotographic image forming apparatus according to claim 3, wherein a driving member for moving the opening portion of said cartridge is provided in the main body of said electrophotographic image forming apparatus, wherein said opening portion of the cartridge is moved by a force from said driving member.

10. An electrophotographic image forming apparatus according to claim 3, wherein a driving member for moving the opening portion of said cartridge is provided on said developer replenishing container, wherein said opening portion of the cartridge is moved by a force from said driving member.

11. An electrophotographic image forming apparatus according to claim 1, wherein said discharge port of the developer replenishing container is provided on a leading end portion of said developer replenishing container from which said developer replenishing container is inserted into the main body of said electrophotographic image forming apparatus.

12. An electrophotographic image forming apparatus according to claim 1, wherein said developer receiving port of the cartridge is provided on a leading end portion of said cartridge from which said cartridge is inserted into the main body of said electrophotographic image forming apparatus.

13. An electrophotographic image forming apparatus in which a plurality of cartridges and developer replenishing containers are attachably and detachably positioned, wherein each of said developer replenishing containers has a developer containing portion for containing a developer, a discharge port for discharging a developer contained in said developer containing portion to a developer containing portion of a corresponding one of said cartridges, and a replenishing container opening and closing member for openably sealing said discharge port, and in a state where said cartridges are mounted to a main body of said electrophotographic image forming apparatus, the replenishing container opening and closing members of said plurality of developer replenishing containers can be simultaneously moved from respective sealed positions of said discharge ports to respective opened positions.

14. An electrophotographic image forming apparatus in which a plurality of cartridges and developer replenishing containers are attachably and detachably positioned, wherein each of said cartridges has developing means for developing an electrostatic latent image formed on an electrophotographic photosensitive member using a developer, a developer containing portion for containing the developer used in developing with said developing means, a developer receiving port for receiving the developer contained in a corresponding one of said developer replenishing containers into said developer containing portion, and a cartridge opening and closing member for openably sealing said developer receiving port, and in a state where said cartridges are mounted to a main body of said electrophotographic image forming apparatus, the cartridge opening and closing members of said plurality of cartridges can be simultaneously moved from respective sealed positions of said developer receiving ports to respective opened positions.

* * * * *

UNITED STATES PATENT AND TRADEMARK OFFICE

CERTIFICATE OF CORRECTION

PATENT NO. : 6,324,370 B1
DATED : November 27, 2001
INVENTOR(S) : Hironobu Isobe et al.

It is certified that error appears in the above-identified patent and that said Letters Patent is hereby corrected as shown below:

Title page,
Item [57], ABSTRACT,
Line 3, "attachable/detachably" should read -- attachably/detachably --
Line 8, "attachable/detachably" should read -- attachably/detachably --.

Column 1,
Line 33, "by not" should read -- not by --, and "but" should read -- but by --.

Column 2,
Line 43, "the an" should read -- the --.

Column 3,
Line 41, "Embodiment" should read -- Embodiment 1; --.

Column 4,
Line 2, "Embodiment 1;" should read -- Embodiment 1. --.
Line 56, "of a" should read -- is of a --.

Column 8,
Line 10, "an light" should read -- a light --.
Line 52, "counterclockwise" should read -- counterclockwise direction --.

Column 13,
Line 29, "as an" should read -- as a --.

Column 15,
Line 59, "FIG. 8" should read -- FIG. 8, --.
Line 61, "Here, a case where" should read -- Here is a case where --.

Column 17,
Line 6, "12c," should read -- 12C, --.

Column 19,
Line 26, "100. In" should read -- 100, in --.

Column 20,
Line 57, "9h" should read -- 9k --.

UNITED STATES PATENT AND TRADEMARK OFFICE

CERTIFICATE OF CORRECTION

PATENT NO. : 6,324,370 B1
DATED : November 27, 2001
INVENTOR(S) : Hironobu Isobe et al.

It is certified that error appears in the above-identified patent and that said Letters Patent is hereby corrected as shown below:

Column 21,
Line 18, "9h" should read -- 9K --.
Line 22, "9h" should read -- 9K --.
Line 24, "shown" should read -- shown in --.
Line 31, "so called" should read -- so-called --.

Column 22,
Line 1, "combined" should read -- combining --.

Signed and Sealed this

Eighth Day of October, 2002

*Attest:*

*Attesting Officer*

JAMES E. ROGAN
*Director of the United States Patent and Trademark Office*